US009217982B2

(12) United States Patent
Hashimoto

(10) Patent No.: US 9,217,982 B2
(45) Date of Patent: Dec. 22, 2015

(54) IMAGE FORMING APPARATUS WITH SYNCHRONIZED GEAR TRANSMISSION MECHANISM

(75) Inventor: Yohei Hashimoto, Nagakute (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 198 days.

(21) Appl. No.: 13/416,185

(22) Filed: Mar. 9, 2012

(65) Prior Publication Data

US 2012/0230731 A1 Sep. 13, 2012

(30) Foreign Application Priority Data

Mar. 10, 2011 (JP) ..... 2011-053154

(51) Int. Cl.
*G03G 15/00* (2006.01)
*G03G 15/01* (2006.01)

(52) U.S. Cl.
CPC ..... *G03G 15/757* (2013.01); *G03G 15/0178* (2013.01); *G03G 15/5008* (2013.01); *G03G 2215/0119* (2013.01); *G03G 2215/0158* (2013.01)

(58) Field of Classification Search
CPC ..... G03G 15/757; G03G 15/0178; G03G 15/5008; G03G 2215/0119; G03G 2215/0141; G03G 2215/1657; G03G 2215/0158
USPC ..... 399/167, 299; 347/115, 117, 118
See application file for complete search history.

(56) References Cited

U.S. PATENT DOCUMENTS

| | | | | |
|---|---|---|---|---|
| 5,970,286 | A * | 10/1999 | Numazu et al. | 399/167 |
| 6,142,690 | A * | 11/2000 | Yoshimura et al. | 400/636.2 |
| 7,555,242 | B2 * | 6/2009 | Zensai | 399/167 |
| 7,738,812 | B2 * | 6/2010 | Kim et al. | 399/167 |
| 8,335,458 | B2 * | 12/2012 | Ino et al. | 399/167 |
| 8,503,910 | B2 * | 8/2013 | Matsuda | 399/167 |
| 8,543,038 | B2 * | 9/2013 | Ito | 399/167 |
| 8,626,028 | B2 * | 1/2014 | Kim | 399/167 |
| 2010/0028046 | A1 | 2/2010 | Abe et al. | |

FOREIGN PATENT DOCUMENTS

| | | |
|---|---|---|
| JP | 05-341589 | 12/1993 |
| JP | 06-274077 | 9/1994 |

(Continued)

OTHER PUBLICATIONS

Notice of Reasons for Rejection issued in corresponding Japanese Patent Application No. 2011-053154 dated Feb. 19, 2013.

(Continued)

*Primary Examiner* — Robert Beatty
(74) *Attorney, Agent, or Firm* — Banner & Witcoff, Ltd.

(57) ABSTRACT

An image forming apparatus includes gears for driving a first photosensitive drum and a second photosensitive drum. The gears includes a first drum gear, a second drum gear, and a first drive gear configured to apply a rotational force to the first drum gear and the second drum gear by meshing with the first drum gear and the second drum gear. Specific positional relations among the first photosensitive drum, the second photosensitive drum, the first drum gear, the second drum gear, and the first drive gear are configured based on exposure positions and transfer position. Such an image forming apparatus may reduce an occurrence of an image formation failure even when the dimensional unevenness of the gears occurs.

10 Claims, 18 Drawing Sheets

(56) References Cited

FOREIGN PATENT DOCUMENTS

| | | | |
|---|---|---|---|
| JP | 08-194361 | | 7/1996 |
| JP | 09-179372 | | 7/1997 |
| JP | 2002-189325 | | 7/2002 |
| JP | 2003-035983 | | 2/2003 |
| JP | 2004-117386 | | 4/2004 |
| JP | 2005-181697 | | 7/2005 |
| JP | 2005-181702 | | 7/2005 |
| JP | 2005-215126 | | 8/2005 |
| JP | 2007-120609 | A | 5/2007 |
| JP | 2008-145458 | A | 6/2008 |
| JP | 2010-186155 | | 8/2010 |

OTHER PUBLICATIONS

Decision of Final Rejection issued in corresponding Janapese Patent Application No. 2011-053154 mailed Oct. 1, 2013.

Office Action issued in corresponding Chinese Application No. 201210062521.0 dated Mar. 3, 2014.

Office Action issued in corresponding Chinese Patent Application No. 201210062521.0 mailed Sep. 15, 2014.

Extended European Search Report issued in corresponding European Patent Application No. 12158737.2, dated Dec. 5, 2014.

* cited by examiner

IMAGE FORMING APPARATUS WITH SYNCHRONIZED GEAR TRANSMISSION MECHANISM

CROSS REFERENCE TO RELATED APPLICATION

This application claims priority from Japanese Patent Application No. 2011-053154, which was filed on Mar. 10, 2011, the entire subject matter of which is incorporated herein by reference.

BACKGROUND

1. Technical Field

The present invention relates to an image forming apparatus which forms an image by transferring a developer image to a transferred member such as paper or a transfer belt.

2. Related Art

In a tandem-type image forming apparatus in which a plurality of photosensitive drums are arranged along the direction of movement of a transferred member, a plurality of developer images are superimposed on the transferred member. Therefore, these photosensitive drums are rotated synchronously so that the circumferential speeds of the plurality of the photosensitive drum match at the time of transfer.

Assuming that the circumferential speeds of the respective photosensitive drums at the time of transfer do not match, the transfer positions of the developer images with respect to the transferred member are shifted, so that an image formation failure such as so-called "color deviation (print deviation)" occurs, and hence the quality of the formed image is deteriorated.

Therefore, for example, an image forming apparatus in which errors in transmission of a drive force to respective photosensitive drums are reduced in comparison with a case where the plurality of the photosensitive drums are driven by a plurality of drive motors by driving drum gears provided on the plurality of the photosensitive drums respectively with a single electric motor via an intermediate gear, thereby inhibiting an occurrence of an image formation failure is known.

When the drive force of the electric motor is transmitted to the drum gear via a plurality of gears, the image formation failure may occur also due to dimensional unevenness of the gears.

In other words, (a) when a reference pitch circle of the gear is not a complete round and the radius of a reference pitch circle varies from portion to portion of the gear, the circumferential speed varies even when the angular speeds are the same. (b) When the reference pitches (dimensions between adjacent teeth) are different from portion to portion of the gear, the circumferential speed of a driven gear which meshes the gear and receives the drive force varies even when the angular speed and the radius of the reference pitch circle are the same.

SUMMARY

In view of such circumstances, a need has arisen to reduce an occurrence of an image formation failure even when the dimensional unevenness of the gears occurs.

Aspects of the invention provide an image forming apparatus which includes gears for driving a first photosensitive drum and a second photosensitive drum disposed at a position shifted forward in the direction of movement of a transferred member with respect to the first photosensitive drum. The image forming apparatus includes a first drum gear, a second drum gear, and a first drive gear configured to apply a rotational force to the first drum gear and the second drum gear by meshing with the first drum gear and the second drum gear. Specific positional relations among the first photosensitive drum, the second photosensitive drum, the first drum gear, the second drum gear, and the first drive gear are configured based on exposure positions and transfer positions.

BRIEF DESCRIPTION OF THE DRAWINGS

For a more complete understanding of the present invention, the needs satisfied thereby, and the features and advantages thereof, reference now is made to the following descriptions taken in connection with the accompanying drawings wherein.

DETAILED DESCRIPTION

Figure 1:
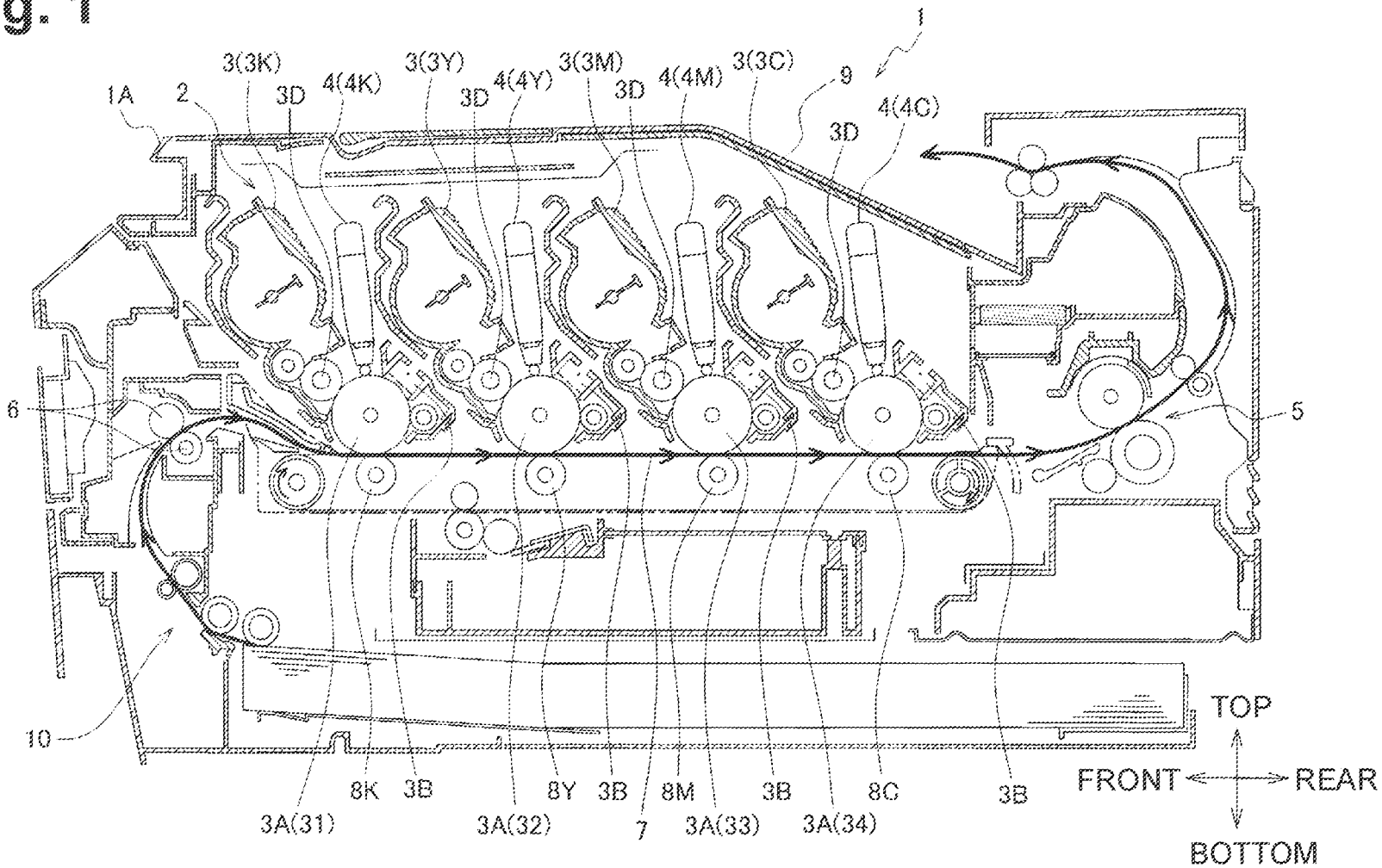
FIG. 1 is a cross-sectional view of an image forming apparatus according to an embodiment of the invention taken along a center thereof.

Embodiments of the invention and their features and advantages may be understood by referring to FIGS. 1-18, like numerals being used for like corresponding parts in the various drawings. Hereinafter, an embodiment of the invention will be described by appropriately referring to the drawings. Further, the embodiment to be described below is merely an example of the invention, and may be, of course, appropriately modified within the scope in which the concept of the invention is not changed.

1. General Configuration of Image Forming Apparatus

An image forming apparatus 1 includes an image forming unit 2 and a paper feed device 10 as shown in FIG. 1. The image forming unit 2 is an image forming unit configured to form an image on paper or an OHP sheet (hereinafter, referred to as "sheet"), and the paper feed device 10 is a paper feeder configured to feed the paper to the image forming unit 2.

The image forming unit 2 in the embodiment is an image forming device including a process cartridge 3, an exposure unit 4, and fixer 5. A plurality of (four, in the embodiment) process cartridges 3K to 3C are provided for respective colors (for each of black, yellow, magenta, and cyan in the embodiment) and also are disposed discretely along the direction of transport of paper as a transferred member.

The respective process cartridges 3K to 3C each include a photosensitive drum 3A on which a developer image is carried, a charger 3B configured to charge the photosensitive drums 3A, and a developing roller 3D configured to supply developer to the photosensitive drum 3A stored therein. The exposure unit 4 is an exposure device including a number of LEDs arranged along the direction of axes of the photosensitive drums 3A. In the embodiment, exposure units 4K to 4C are provided for the process cartridges 3K to 3C, respectively.

The paper carried out from the paper feed device 10 toward the image forming unit 2 is transported to a pair of registration rollers 6 provided on the inlet side of the image forming unit 2 and is fed toward the image forming unit 2 at a predetermined timing after having corrected in skew by the pair of registration rollers 6.

In contrast, the respective charged photosensitive drums 3A are exposed by the respective exposing units 4. After having formed electrostatic latent images on an outer peripheral surfaces thereof, the developer is supplied to the respective photosensitive drum 3A by the respective developing rollers 3D and hence the electrostatic latent images are developed, so that developer images are carried (formed) on the outer peripheral surfaces of the photosensitive drums 3A.

At this time, an electric charge having an opposite polarity from the developer is applied to respective transfer rollers 8K to 8C disposed on the opposite side of the photosensitive drum 3A across a transfer belt 7 which transports the paper, and hence the developer images carried on the respective photosensitive drum 3A are directly transferred onto the paper, and the developer images in respective colors are directly superimposed on the paper.

Then, the developer images transferred onto the paper are heated and fixed thereon by the fixer 5, and the paper after having completed the image formation is redirected upward in direction of transport thereof and then is discharged onto a paper discharge tray 9 provided on the side of an upper end surface of the image forming apparatus 1.

2. Drive System of Photosensitive Drum 2.1 Summary of Drive System

In the embodiment, since the four photosensitive drum 3A provided for the respective colors are arranged in series along the direction of movement of the paper (or the transfer belt 7) as described above, the four photosensitive drum 3A are needed to be rotated precisely synchronously in conjunction of the movement of the paper (or the transfer belt 7).

Figure 2:
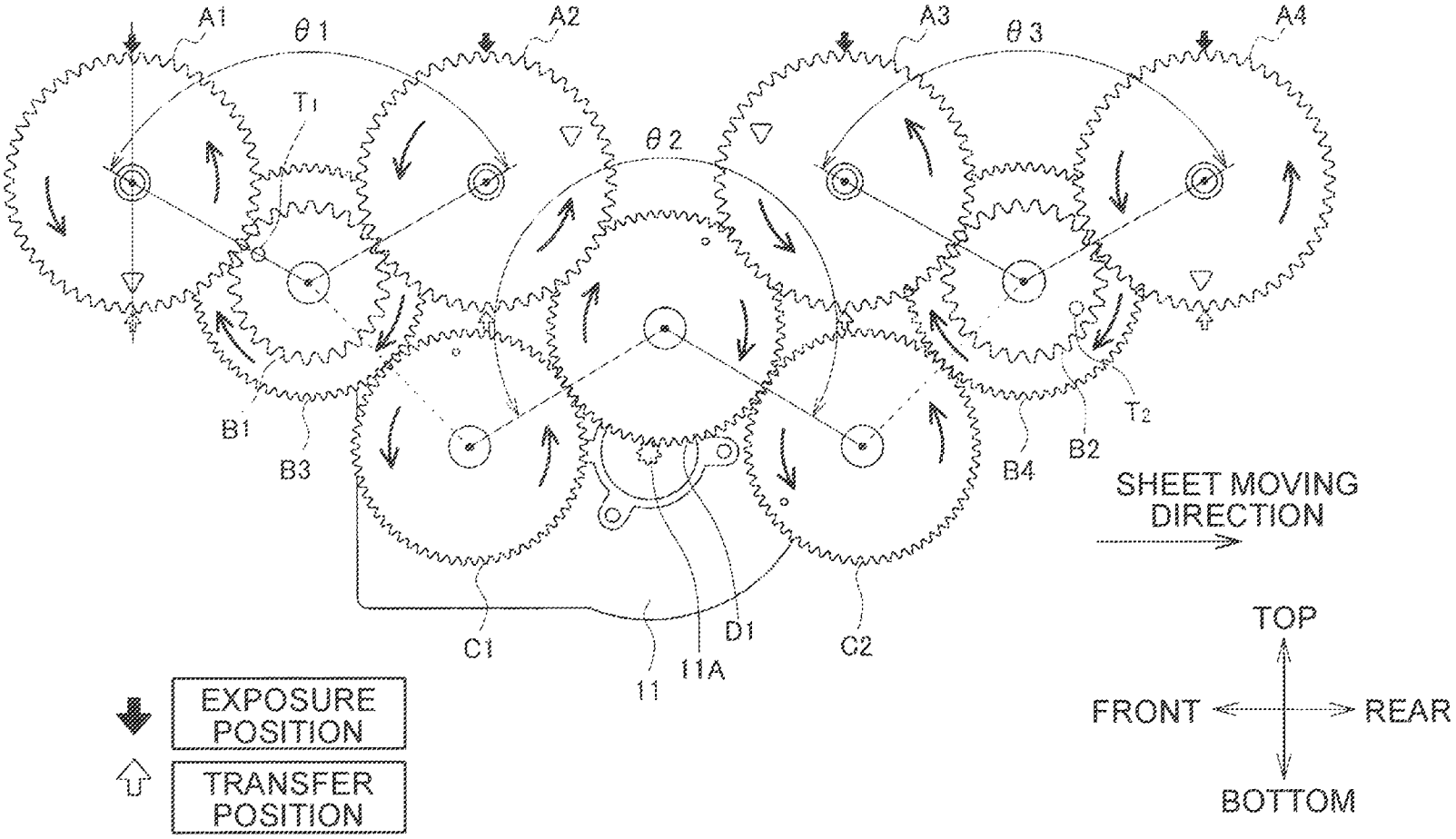
FIG. 2 is a front view showing a gear transmission mechanism according to the embodiment of the invention.
Figure 3:
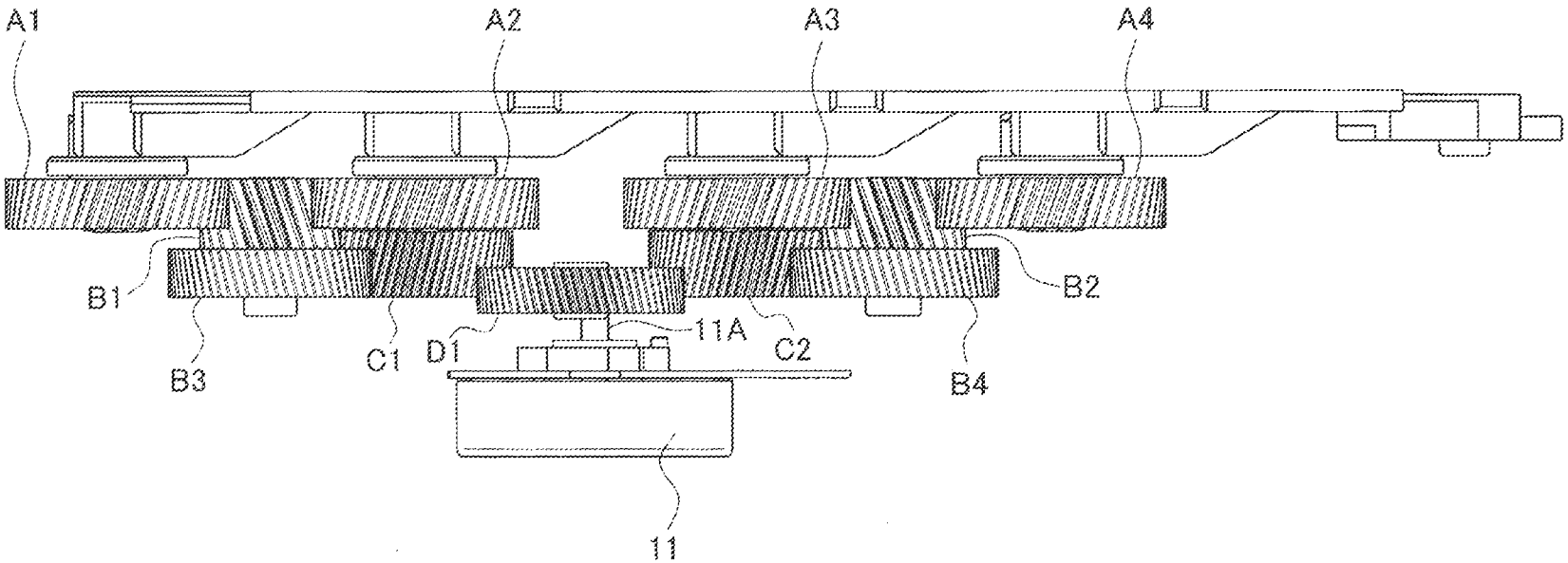
FIG. 3 is a top view showing the gear transmission mechanism according to the embodiment of the invention.

Therefore, in the embodiment, as shown in FIG. 2 and FIG. 3, a rotational force generated in a single power source (electric motor) 11 is distributed and applied to the respective photosensitive drum 3A by a gear transmission mechanism including a plurality of gears A1 to A4, B1 and B2, C1 and C2, and D1 to cause the four photosensitive drum 3A to rotate mechanically synchronously.

2.2. Definition of Respective Gears and Terms

<Definition of Respective Gears (see FIG. 2)>

The gear A1 (hereinafter, referred to as the first drum gear A1) is a gear coupled to a rotating shaft of the photosensitive drum 3A of the process cartridge 3K (hereinafter, referred to as a first photosensitive drum 31), and rotates integrally with the first photosensitive drum 31 to apply a rotational force to the first photosensitive drum 31.

The gear A2 (hereinafter, referred to as the second drum gear A2) is a gear coupled to a rotating shaft of a photosensitive drum 3A of the process cartridge 3Y (hereinafter, referred to as a second photosensitive drum 32), and rotates integrally with the second photosensitive drum 32 to apply a rotational force to the second photosensitive drum 32.

The gear A3 (hereinafter, referred to as the third drum gear A3) is a gear coupled to a rotating shaft of a photosensitive drum 3A of the process cartridge 3M (hereinafter, referred to as a third photosensitive drum 33), and rotates integrally with the third photosensitive drum 33 to apply a rotational force to the third photosensitive drum 33.

The gear A4 (hereinafter, referred to as the fourth drum gear A4) is a gear coupled to a rotating shaft of a photosensitive drum 3A of the process cartridge 3C (hereinafter, referred to as a fourth photosensitive drum 34), and rotates integrally with the fourth photosensitive drum 34 to apply a rotational force to the fourth photosensitive drum 34.

The gear B1 (hereinafter, referred to as the first drive gear B1) is a gear meshed with the first drum gear A1 and the second drum gear A2 to distribute and apply a rotational force to the first drum gear A1 and the second drum gear A2, and the gear B2 (hereinafter, referred to as the second drive gear B2) is a gear meshed with the third drum gear A3 and the fourth drum gear A4 to distribute and apply a rotational force to the third drum gear A3 and the fourth drum gear A4.

A gear B3 (hereinafter, referred to as the first transmission gear B3) is a gear arranged coaxially with the first drive gear B1 and is formed integrally with the first drive gear B1, and a gear B4 (hereinafter, referred to as the second transmission gear B4) is a gear arranged coaxially with the second drive gear B2 and is formed integrally with the second drive gear B2.

The gear C1 (hereinafter, referred to as the first intermediate gear C1) is a gear meshed with the first transmission gear B3 to apply a rotational force to the first drive gear B1, and a the gear C2 (hereinafter, referred to as the second intermediate gear C2) is a gear meshed with a second transmission gear B4 to apply a rotational force to the second drive gear B2.

The gear D1 (hereinafter, referred to as the distribution gear D1) is a gear meshed with the first intermediate gear C1 and the second intermediate gear C2 to distribute and apply a rotational force transmitted from the drive source 11 toward the first drive gear B1 and the second drive gear B2, and the distribution gear D1 is meshed with a drive shaft 11A of the drive source 11.

Hereinafter, the first to fourth drum gears A1 to A4 are generically referred to as a "drum gear A", the four photosensitive drums are generically referred to as the "photosensitive drum 3A", and the first and second drive gears B1 and B2 are generically referred to as a "drive gears B", and the first and second intermediate gears C1 and C2 are generically referred to as an "intermediate gear C".

The gears A1 to A4, B1 and B2, C1 and C2, and D1 are helical gears disposed so that the direction of lead is inclined with respect to the direction of the axis of rotation thereof as shown in FIG. 3. Specifically, the first to fourth drum gears A1 to A4 are resin mold molded using the same die.

Figure 4:
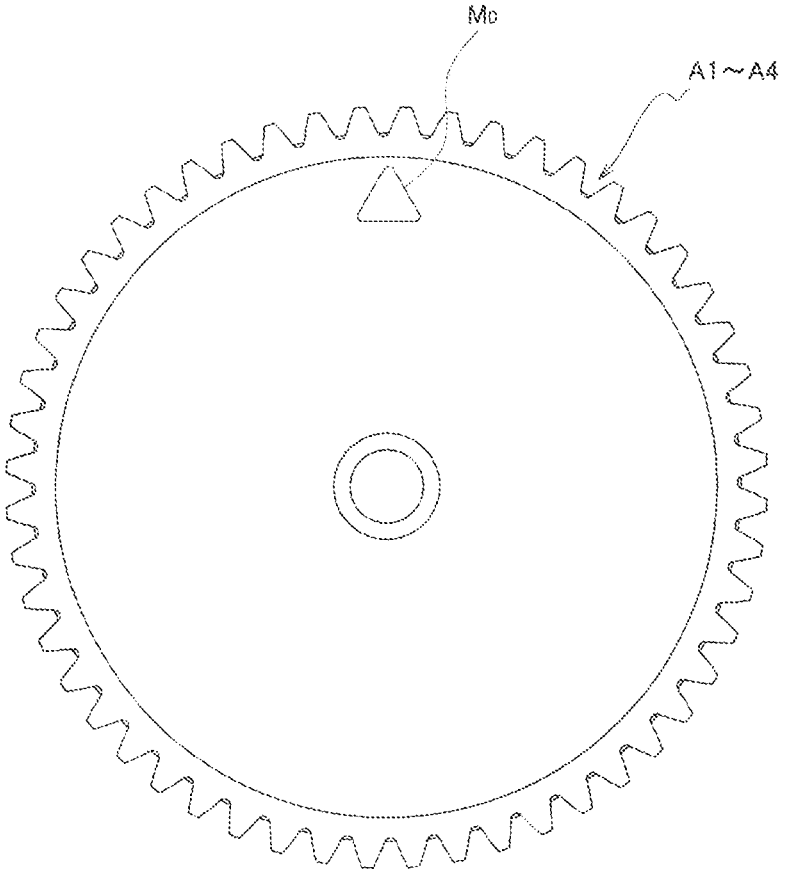
FIG. 4 is a front view showing a gear (a drum gear) according to the embodiment of the invention.

Then, the first to fourth drum gears A1 to A4 are provided on side surfaces thereof with identification marks Mo (triangular signs in FIG. 4) each showing a tooth which serves as a reference from among a plurality of teeth (hereinafter, referred to as a reference tooth) on outer peripheries thereof as shown in FIG. 4, and the identification marks Mo are formed using the gear molding die simultaneously with the molding of the first to fourth drum gears A1 to A4.

For reference sake, since the first drive gear B1 (including the first transmission gear B3) and the second drive gear B2 (including the second transmission gear B4) have the same shape, these gears are also molded using the same die. In the same manner, since the first intermediate gear C1 and the second intermediate gear C2 have the same shape, these gears are molded using the same die as well.

Diameters D of the four photosensitive drums 31 to 34 are same, and the respective photosensitive drums 31 to 34 and the drum gears A1 to A4 corresponding thereto are assumed to rotate at the same angular speed.

DEFINITION OF TERMS

Reference Tooth

The term "reference tooth" is intended to mean arbitrarily selected one of a plurality of teeth (=crests or troughs of the teeth) formed on an outer periphery, and does not have a specific technical significance.

However, since the first to fourth drum gears A1 to A4 are molded using the same die and hence the first to fourth drum gears A1 to A4 may be regarded to be congruent, the shapes of the $k^{th}$ teeth from the reference teeth (the identification marks Mo) in the directions of rotation, the interproximal distances of the $k^{th}$ teeth with respect to adjacent teeth, and the distances from the centers of rotation thereof can be regarded to be the same among all of the drum gears A1 to A4.

In other words, in the first drum gear A1 for example, if the $k^{th}$ reference pitch from the reference tooth (identification mark Mo) is different from the reference pitch in design by an amount Pe, the $k^{th}$ reference pitches of the second to fourth drum gears A2 to A4 are different from the reference pitch in design by the amount Pe.

"First Drum Specific Position"

The term "first drum specific position" means an arbitrarily selected specific position on an outer peripheral surface of the first photosensitive drum 31. In the embodiment, the first photosensitive drum 31 and the first drum gear A1 are rotated integrally. Therefore, a portion of the outer peripheral surface of the first photosensitive drum 31 corresponding to the identification mark Mo is considered to be a first drum specific position Pd1, hereinafter (see FIG. 5).

"First Drive Specific Tooth"

The term "first drive specific tooth T1" means a tooth (=a crest or a trough of the tooth) of the first drive gear B1 meshed with the first drum gear A1 when the first drum specific position Pd1 (the identification mark Mo of the first drum gear A1 in the embodiment) is located at an exposure position.

Figure 5:
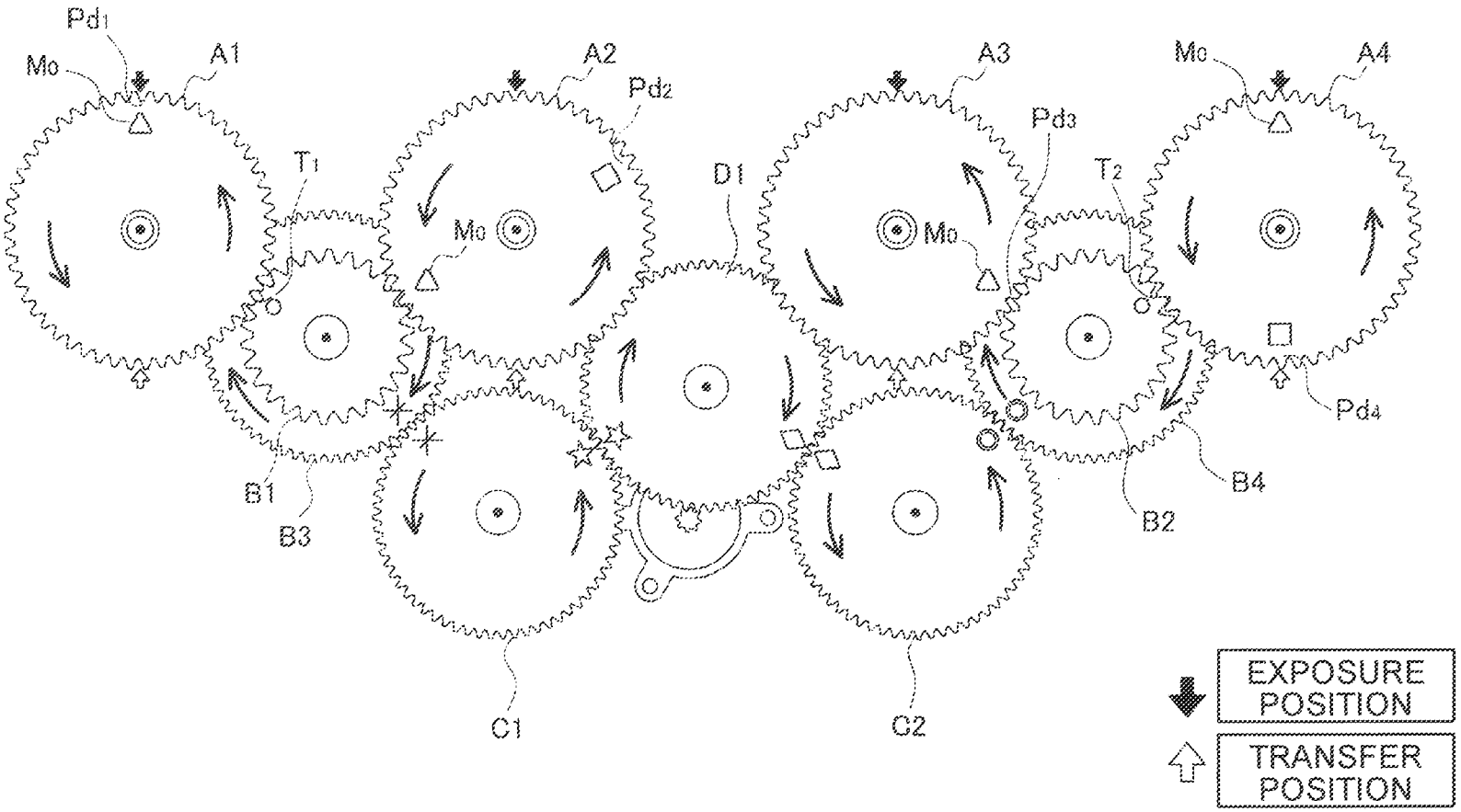
FIG. 5 is a drawing showing the gear transmission mechanism according to the embodiment of the invention.

In FIG. 5, a position marked with a circle corresponds to the first drive specific tooth T1. For reference sake, marks such as the circles, or squares, asterisks, stars, rhomboids, and double circles described below are not provided actually on the gears except for the identification mark Mo (a triangle mark), and are marked conveniently on the drawings for the sake of easy understanding.

The term "exposure position" in the description means a position where the optical axis of light emitted from the exposure unit 4 and an outer periphery of the photosensitive drum 3A and, in the first photosensitive drum 31 for example, an intersection between the optical axis of the exposure unit 4K and a circle indicating the outer periphery of the first photosensitive drum 31. The term "transfer position" means a position where the developer image carried on the photosensitive drum 3A is to be transferred to a transferred member such as paper. In FIG. 5 to FIG. 8, an upper end of the photosensitive drum 3A (the drum gear A) is the exposure position, and a lower end of the photosensitive drum 3A (the drum gear A) is the transfer position.

"Second Drum Specific Position"

Figure 6:
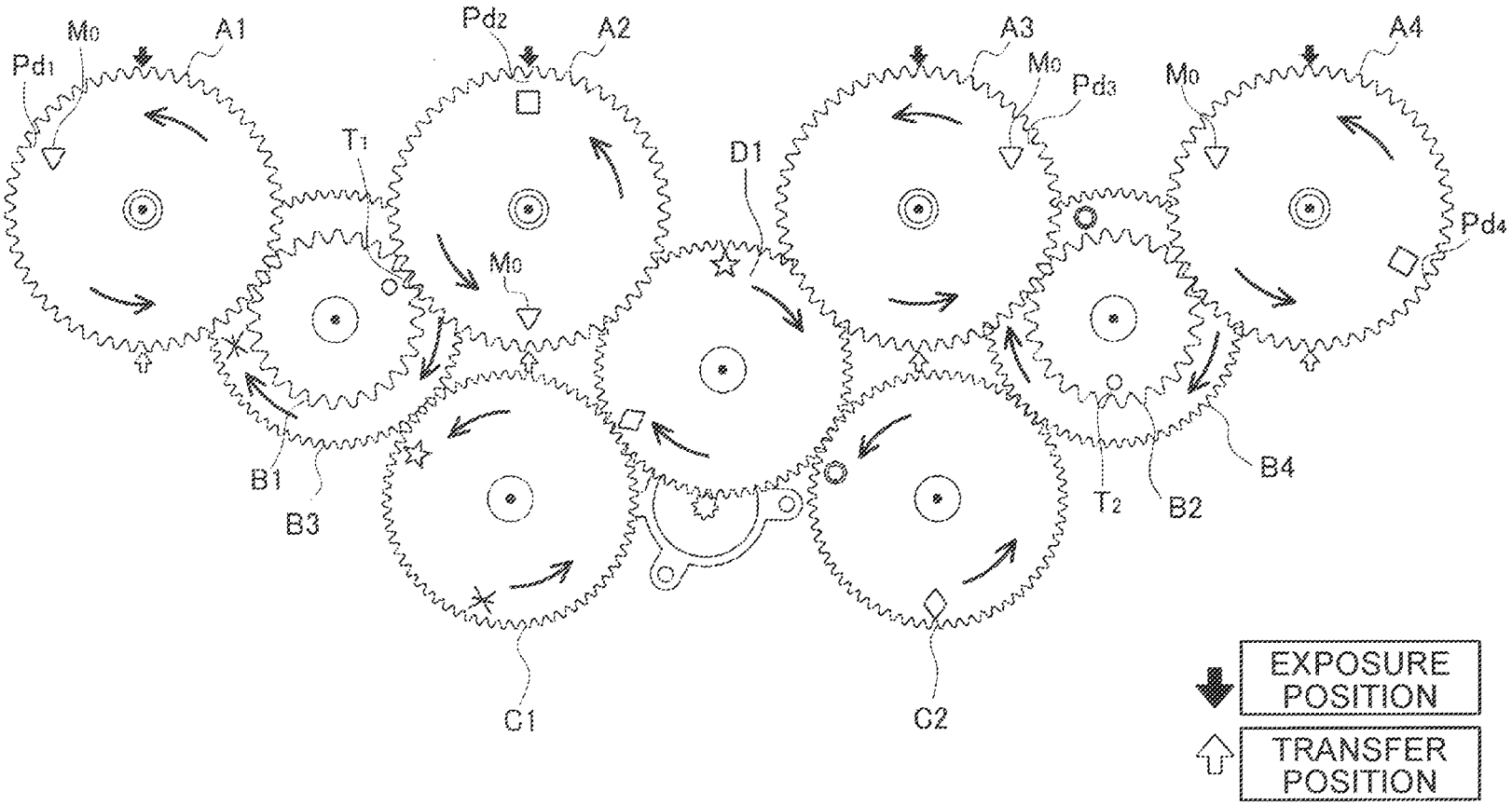
FIG. 6 is a drawing showing the gear transmission mechanism according to the embodiment of the invention.

The term "second drum specific position Pd2" is a portion of an outer peripheral surface of the second photosensitive drum 32 located at the exposure position when the first drive specific tooth T1 is meshed with the second drum gear A2. More specifically, as shown in FIG. 6, the position on the outer peripheral surface of the second photosensitive drum 32 marked with a square corresponds to the second drum specific position Pd2.

"Third Drum Specific Position"

Figure 7:
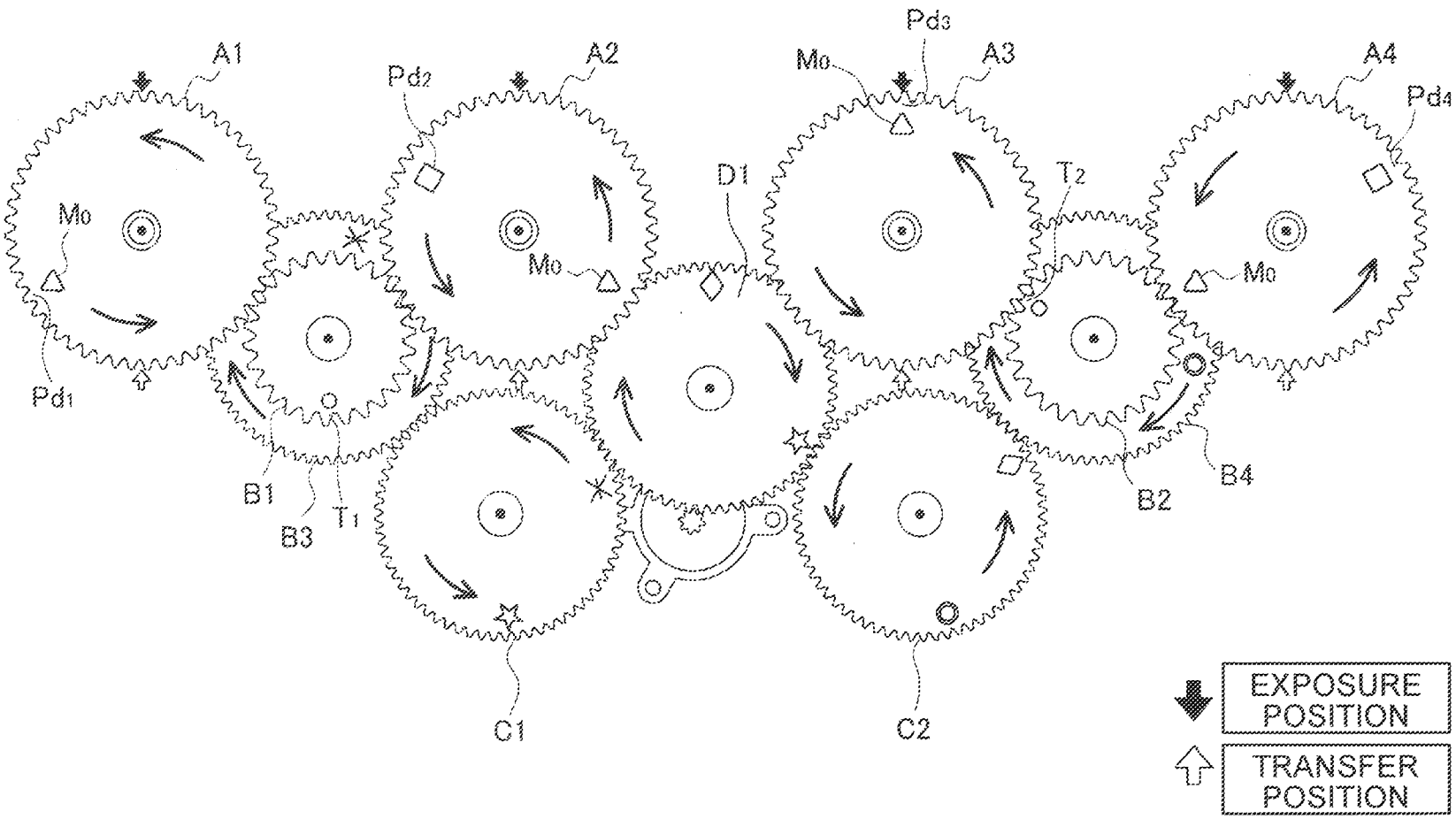
FIG. 7 is a drawing showing the gear transmission mechanism according to the embodiment of the invention.

The term "third drum specific position Pd3" means an arbitrarily selected specific position on an outer peripheral surface of the third photosensitive drum 33 in the same manner as the first drum specific position Pd1. In the embodiment, the third photosensitive drum 33 and the third drum gear A3 are rotated integrally. Therefore, as shown in FIG. 7, a portion of the outer peripheral surface of the third photosensitive drum 33 corresponding to the identification mark Mo is defined as the third drum specific position Pd3.

"Second Drive Specific Tooth"

The term "second drive specific tooth T2" means a tooth (=a crest or a trough of the tooth) of the second drive gear B2 meshed with the third drum gear A3 when the third drum specific position Pd3 is located at the exposure position. In FIG. 7, a position marked with a circle corresponds to the second drive specific tooth T2.

"Fourth Drum Specific Position"

Figure 8:
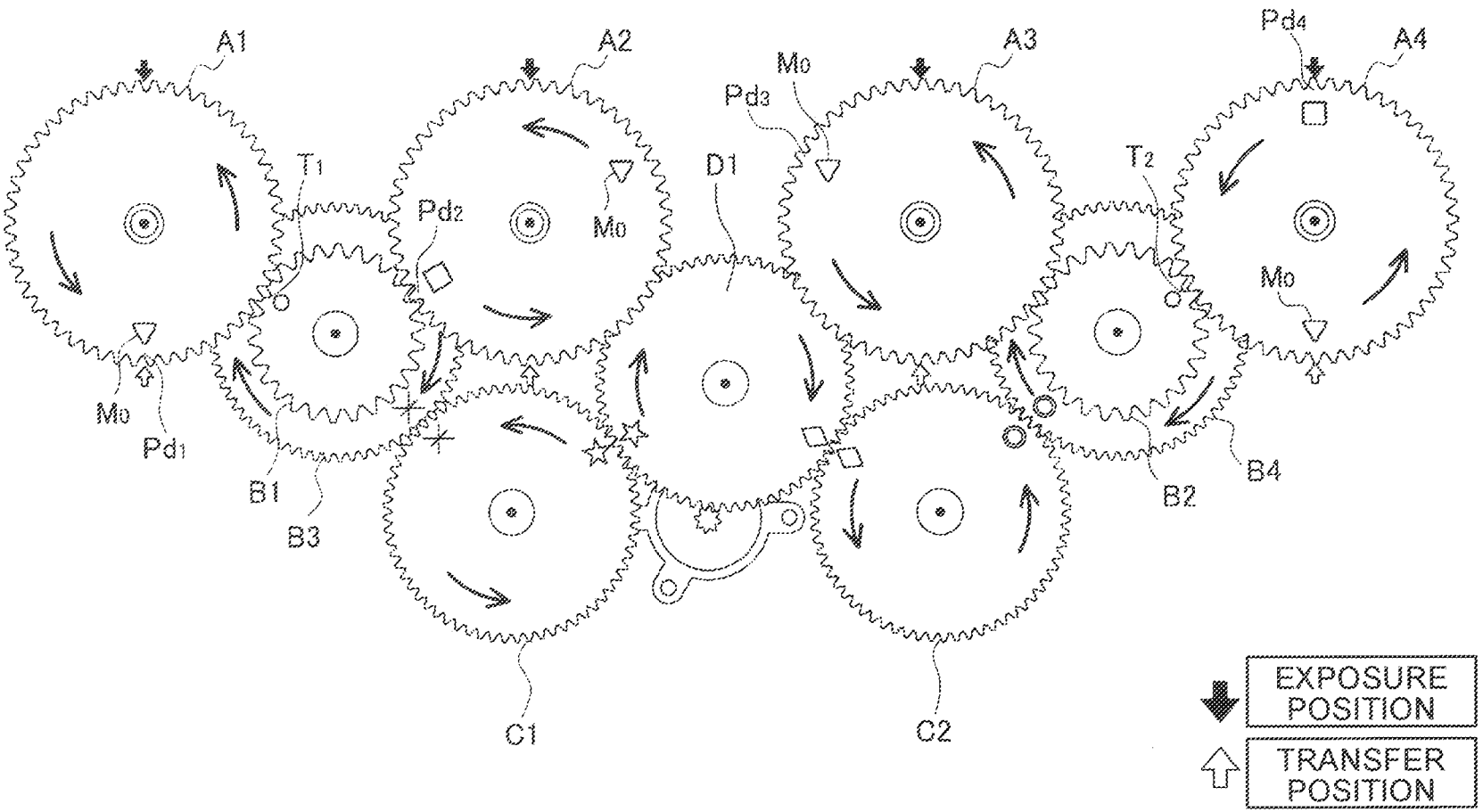
FIG. 8 is a drawing showing the gear transmission mechanism according to the embodiment of the invention.

The term "fourth drum specific position" is a portion of an outer peripheral surface of the fourth photosensitive drum 34 located at the exposure position when the second drive specific tooth T2 is meshed with the fourth drum gear A4. More specifically, as shown in FIG. 8, the position on the outer peripheral surface of the fourth photosensitive drum 34 corresponding to a position marked with a square corresponds to a fourth drum specific position Pd4.

"First Shift Angle"

The term "first shift angle" means a plane angle (=(L1−P1)/L1) obtained by dividing a value obtained by subtracting an axis-to-axis dimension P1 between the first and second photosensitive drums 31 and 32 (see FIG. 9) from a peripheral length L1 (=π·D) of the first photosensitive drum 31 by the peripheral length L1 of the first photosensitive drum 31. The unit of the angle is radian.

"Second Shift Angle"

The term "second shift angle" means a plane angle (=(L1−P2)/L1) obtained by dividing a value obtained by subtracting an axis-to-axis dimension P2 between the first and third photosensitive drums 31 and 33 (see FIG. 9) from the peripheral length L1 of the first photosensitive drum 31 by the peripheral length L1 of the first photosensitive drum 31. The unit of the angle is radian.

"Third Shift Angle"

The term "third shift angle" means a plane angle (=(L1−P3)/L1) obtained by dividing a value obtained by subtracting an axis-to-axis dimension P3 between the first and fourth photosensitive drums 31 and 34 (see FIG. 9) from a peripheral length L1 of the first photosensitive drum 31 by the peripheral length L1 of the first photosensitive drum 31. The unit of the angle is radian.

2.3 Arrangement of Gears (Phase Relationship Among Gears)

Figure 9:
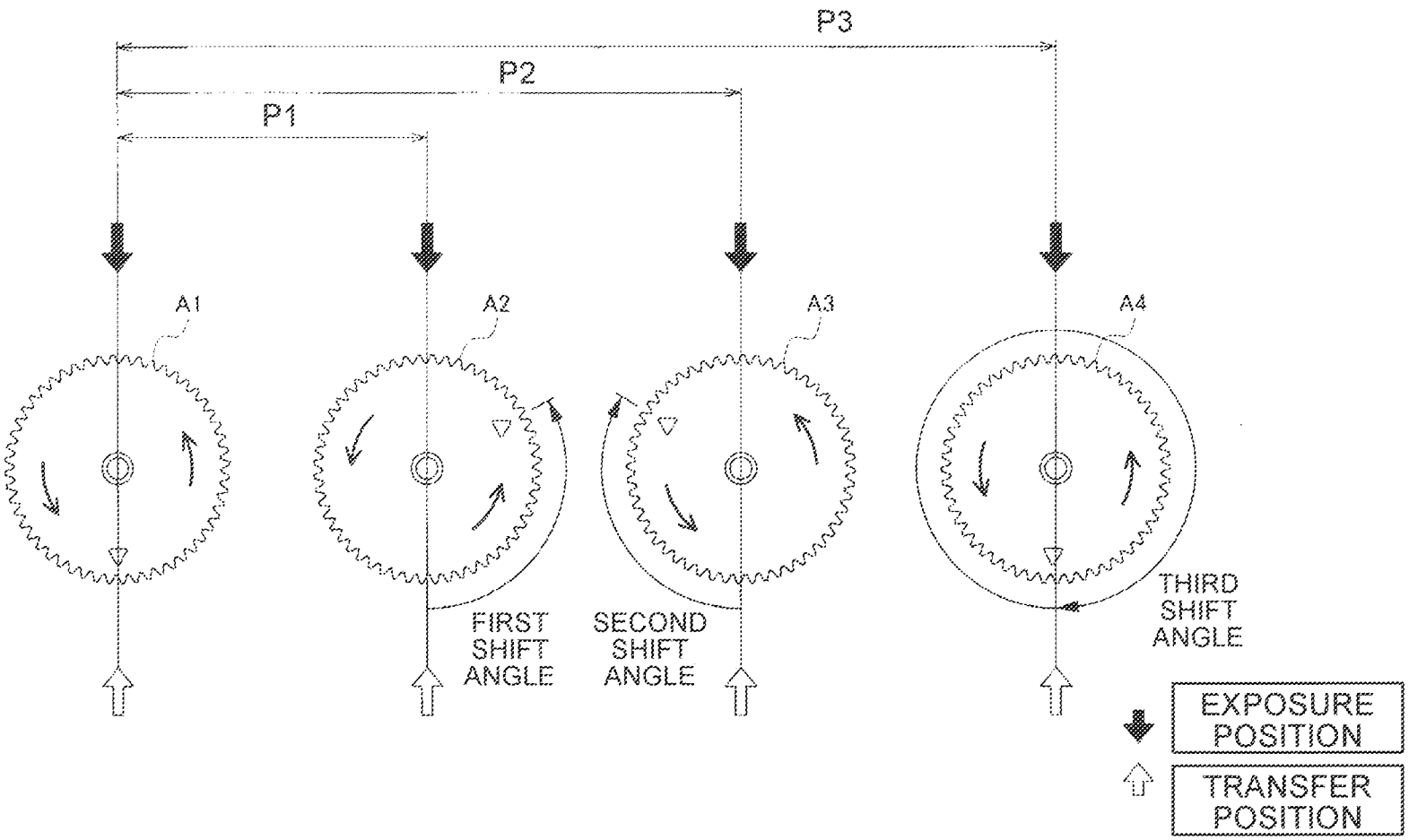
FIG. 9 is a drawing showing an assembling state of the drum gear according to the embodiment of the invention.

As shown in FIG. 9, when a reference tooth of the first drum gear A1 (the tooth corresponding to the triangle mark on the first drum gear A1 in FIG. 9) is located at the transfer position, a reference tooth of the second drum gear A2 (the tooth corresponding to a triangle mark of the second drum gear A2 in FIG. 9) takes a position shifted from the transfer position by a first shift angle (=(L1−P1)/L1). In FIG. 9, the forward direction in the direction of rotation (the direction indicated by arrows in the gears in FIG. 9) is defined to be a normal direction.

At this time, since L1>P1 is established in the embodiment, the first shift angle is an angle measured in the forward direction in the direction of rotation (the normal direction).

When the reference tooth of the first drum gear A1 is located at the transfer position, a reference tooth of the third drum gear A3 (the tooth corresponding to a triangle mark of the third drum gear A3 in FIG. 9) takes a position shifted from the transfer position by a second shift angle (=(L1−P2)/L1), and a reference tooth of the fourth drum gear A4 (the tooth corresponding to the triangle mark on the fourth drum gear A4 in FIG. 9) takes a position shifted by a third shift angle.

At this time, since L1<P1 and L1<P3 are established in the embodiment, the second shift angle and the third shift angle are angles measured in the backward direction in the direction of rotation (negative direction).

Figure 10:
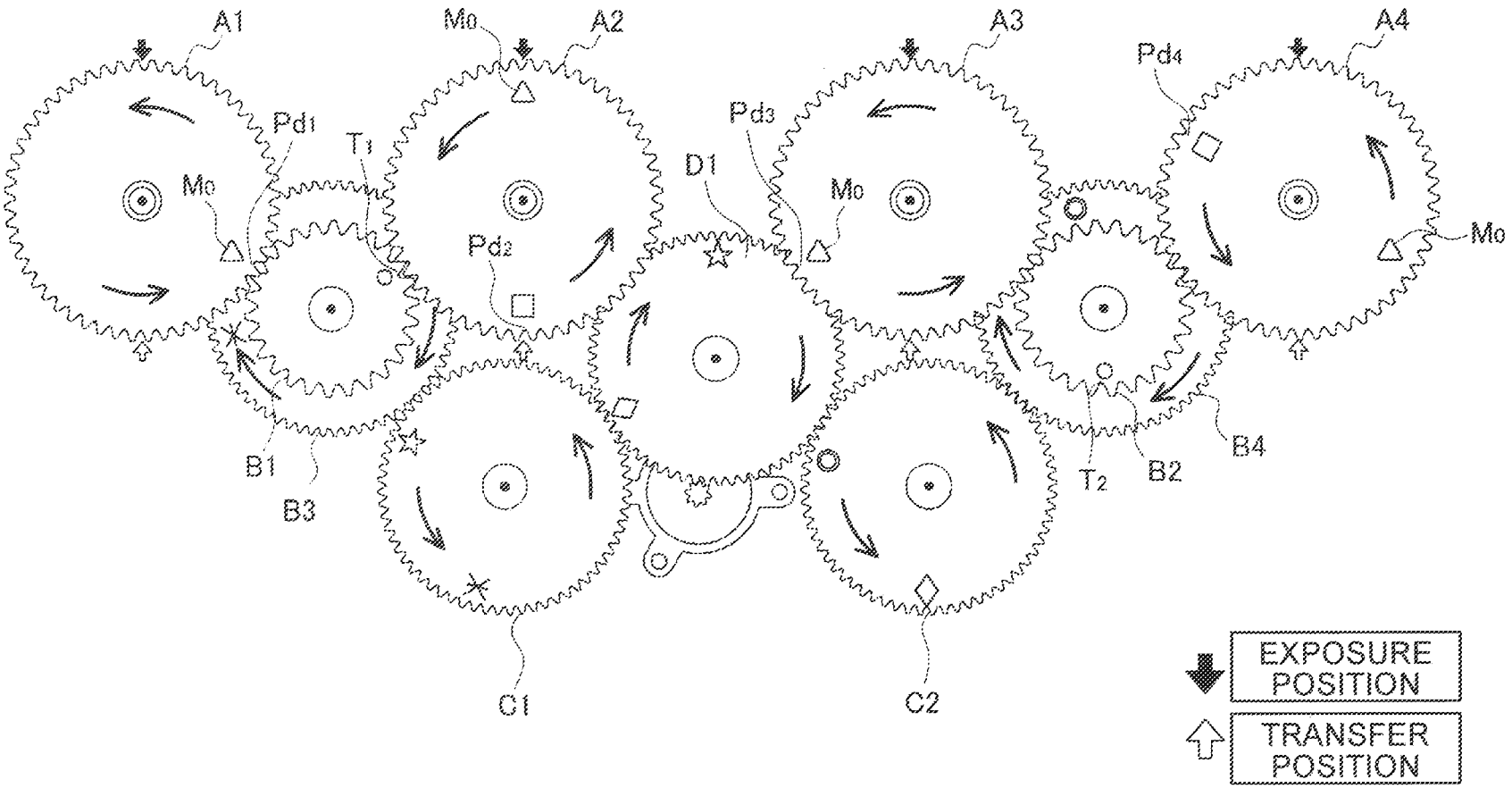
FIG. 10 is a drawing showing the gear transmission mechanism according to the embodiment of the invention.
Figure 11:
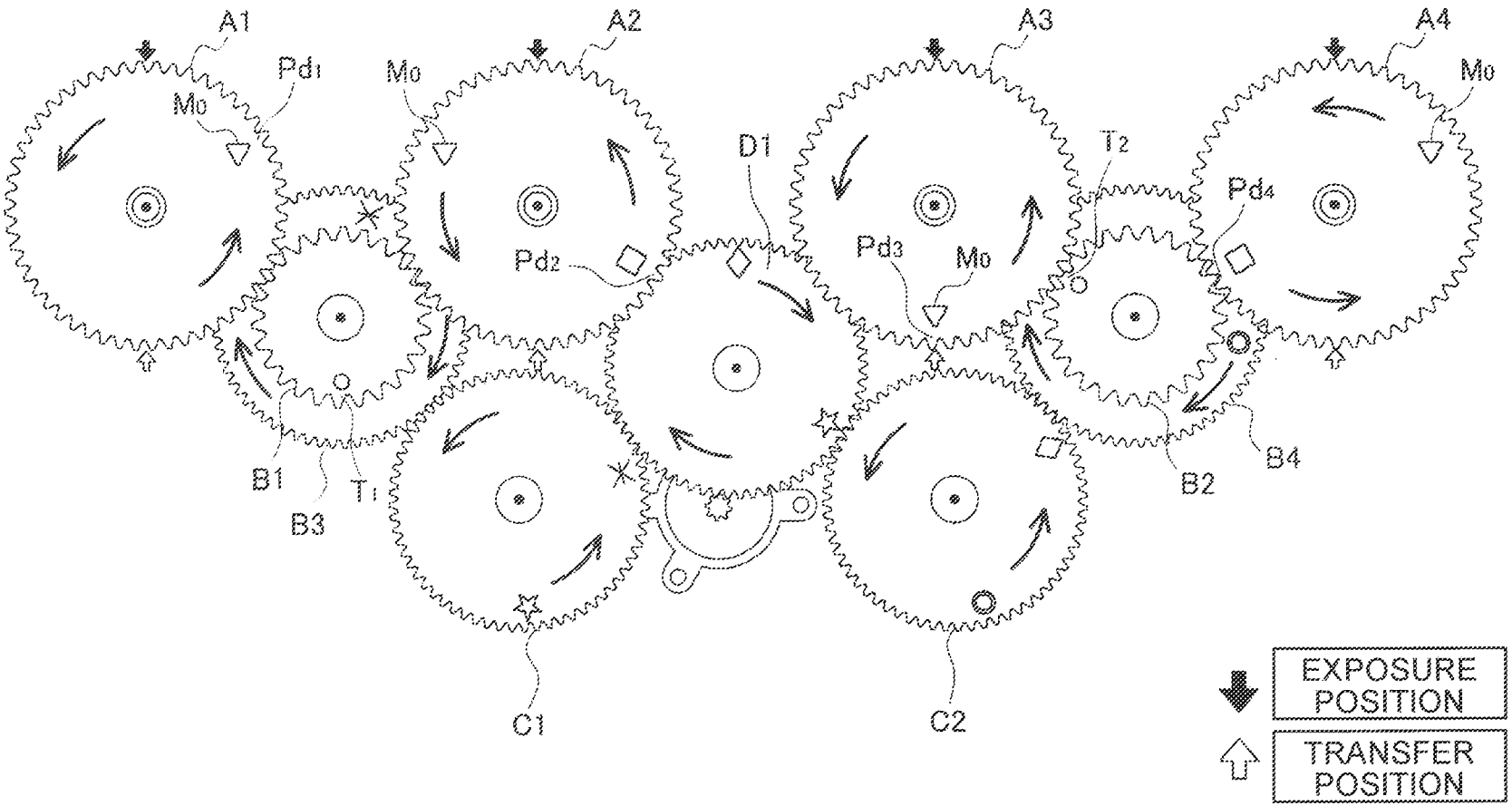
FIG. 11 is a drawing showing the gear transmission mechanism according to the embodiment of the invention.

When the first drum specific position Pd1 (the position corresponding to the triangle mark on the first drum gear A1 in the embodiment) is located at the transfer position, the first drive specific tooth T1 is meshed with the first drum gear A1 (see FIG. 8), and when the second drum specific position Pd2 (a position corresponding to a position indicated by a square mark on the second drum gear A2) is located at the transfer position, the first drive specific tooth T1 is meshed with the second drum gear A2 (see FIG. 10).

Figure 12:
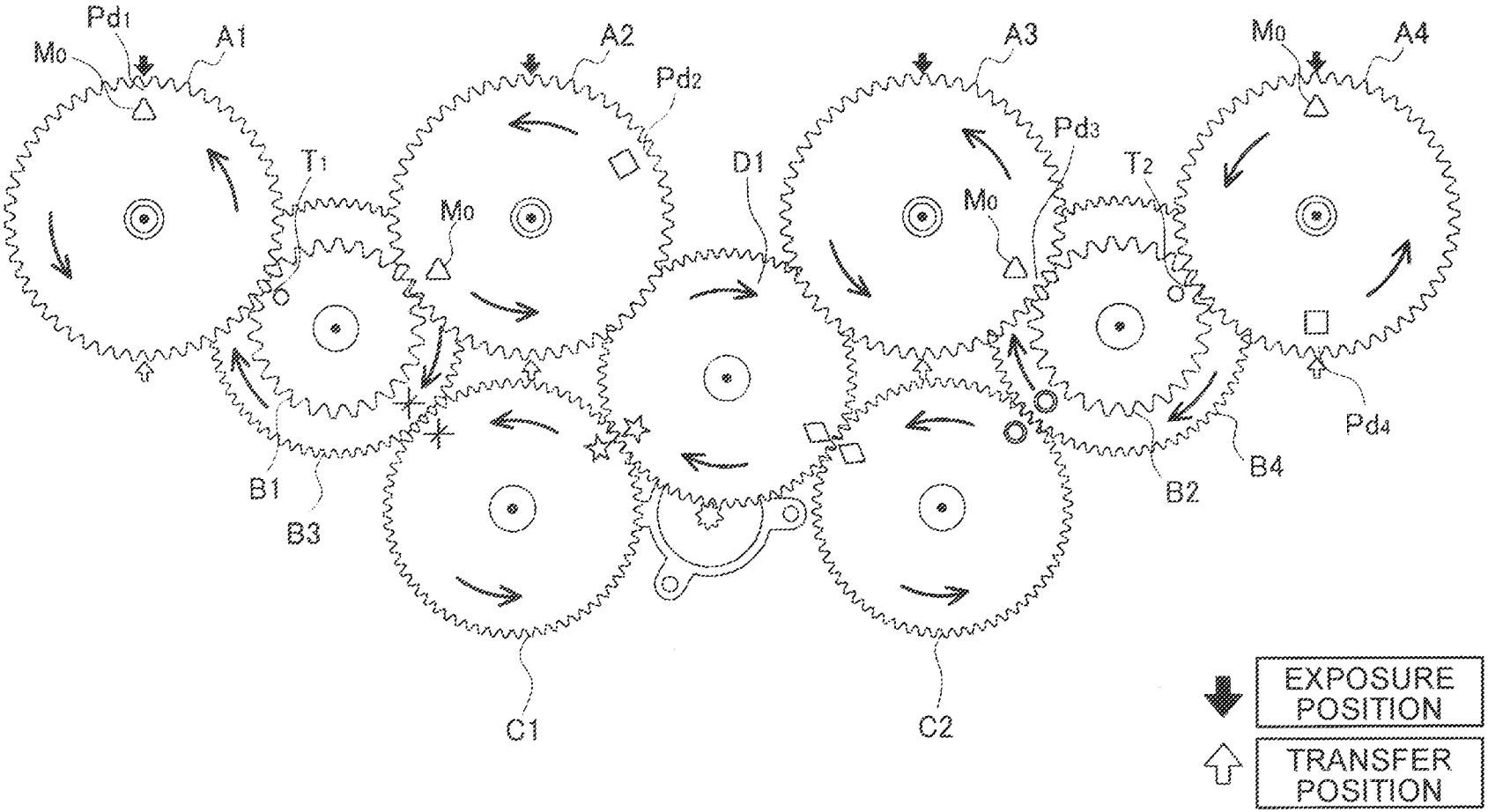
FIG. 12 is a drawing showing the gear transmission mechanism according to the embodiment of the invention.

In the same manner, when the third drum specific position Pd3 (the position corresponding to the triangle mark on the third drum gear A3 in the embodiment) is located at the transfer position, the second drive specific tooth T2 is meshed with the third drum gear A3 (see FIG. 11), and when the fourth drum specific position Pd4 (a position corresponding to a position indicated by a square mark on the fourth drum gear A4) is located at the transfer position, the second drive specific tooth T2 is meshed with the fourth drum gear A4 (see FIG. 12).

In the embodiment, as shown in FIG. 2, an angle θ1 formed between an imaginary line passing through the center of rotation of the first drum gear A1 and the center of rotation of the first drive gear B1 and an imaginary line passing through the center of rotation of the second drum gear A2 and the center of rotation of the first drive gear B1 (hereinafter, this angle is referred to as the drive angle θ1) is set to be equal to an angle θ3 formed between an imaginary line passing through the center of rotation of the third drum gear A3 and the center of rotation of the second drive gear B2 and an imaginary line passing through the center of rotation of the fourth drum gear A4 and the center of rotation of the second drive gear B2.

Furthermore, an angle θ2 formed between an imaginary line passing through the center of rotation of the distribution gear D1 and the center of rotation of the first intermediate gear C1 and an imaginary line passing through the center of rotation of the gear D1 and the center of rotation of the second intermediate gear C2 (hereinafter, this angle is referred to as the transmission angle θ2) is twice the drive angle θ1 and the drive angle θ1 is set to be π/2 radian or larger.

2.4. Coupling Structure Between Photosensitive Drum and Drum Gear

Figure 13B:
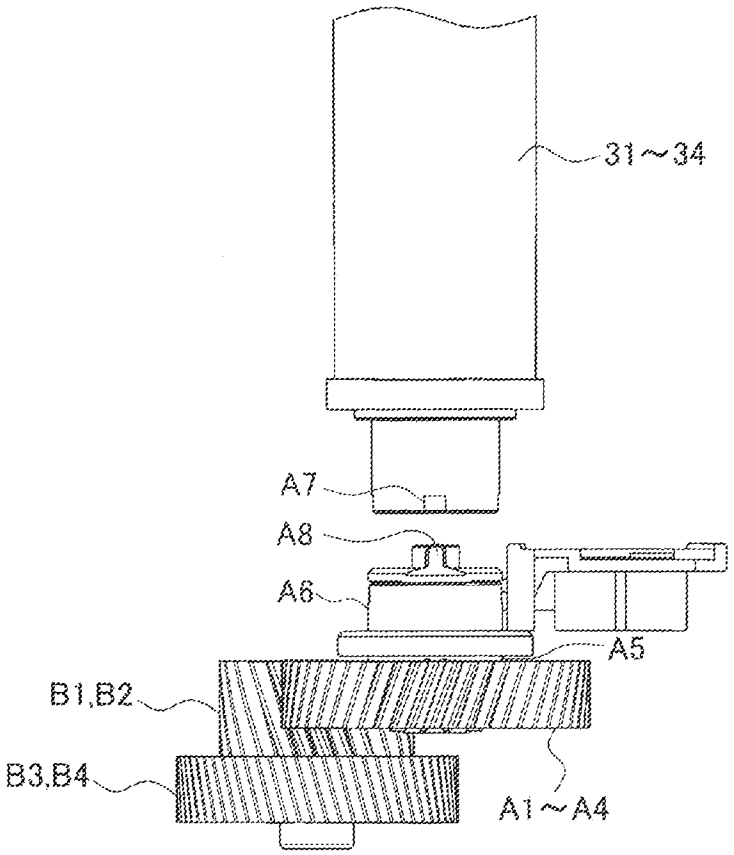
FIGS. 13A and 13B are drawings showing actions of a coupling mechanism configured to couple a photosensitive drum and the drum gear.
Figure 13A:
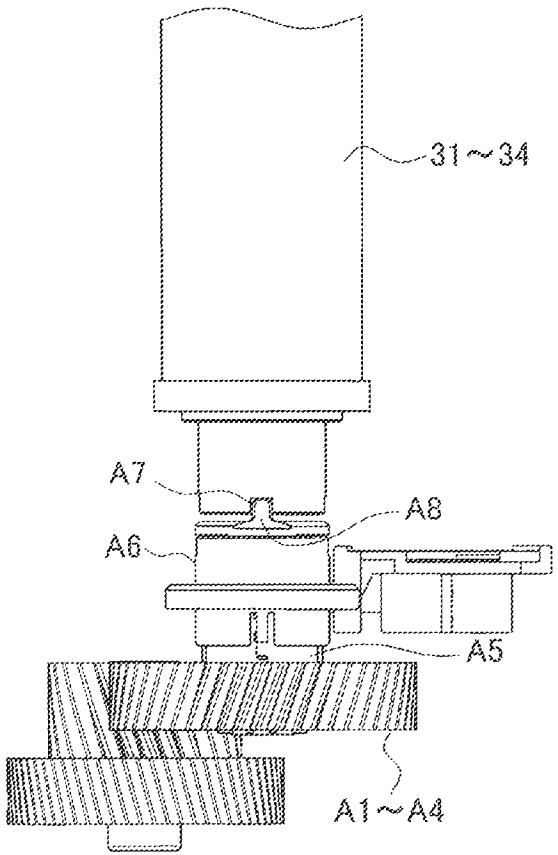

The respective photosensitive drums 31 to 34 and the first to fourth drum gears A1 to A4 corresponding thereto each rotate integrally with a rotating shaft A5 of each of the first to fourth drum gears A1 to A4, and are each coupled to the rotating shaft A5 by a joint A6 which is displaceable in the axial direction thereof, as shown in FIG. 13A.

In other words, the joint A6 is provided with an engaging portion A8 which engages with an engaged portion A7 provided on each of the photosensitive drums 31 to 34 on the side of the photosensitive drums 31 to 34.

Then, in a state in which the engaged portion A7 and the engaging portion A8 engage, the first to fourth drum gears A1 to A4 and the photosensitive drums 31 to 34 corresponding thereto rotate integrally as shown in FIG. 13A. In contrast, in a state in which the engaged portion A7 and the engaging portion A8 are disengaged, the drum gears A1 to A4 and the photosensitive drums 31 to 34 are separate from each other as shown in FIG. 13B.

When an opening and closing cover 1A which covers the process cartridges 3K to 3C (see FIG. 1) is opened in order to dismount the process cartridges 3K to 3C from an apparatus body, the joint A6 is displaced toward the drum gears A1 to A4 correspondingly, so that the engaged portion A7 and the engaging portion A8 are separated from each other. In contrast, when the opening and closing cover 1A is closed, the joint A6 is moved toward the photosensitive drums 31 to 34 correspondingly, so that the engaged portion A7 and the engaging portion A8 engage.

2.5. Action of Drive System

In the embodiment, the exposure position and the transfer position are shifted by approximately it radian, and the number of teeth of the drum gear A is twice the number of teeth of the drive gears B, and the numbers of teeth of the drive gears B, the intermediate gears C, and the distribution gear D1 are the same. Therefore, when the first to the fourth drum specific positions Pd1 to Pd4 rotate from the exposure position to the transfer position, the gears other than the drum gear A make a 360° turn.

In other words, the exposure and the transfer are executed in sequence from the photosensitive drum 3A on the upstream side in the direction of movement of the paper (the transfer belt 7) so that the gears other than the drum gear A make a 360° turn while the respective photosensitive drum 3A have been exposed and developed, and then the developer images carried on the photosensitive drum 3A are transferred from the photosensitive drum 3A onto the paper.

Figure 14A:
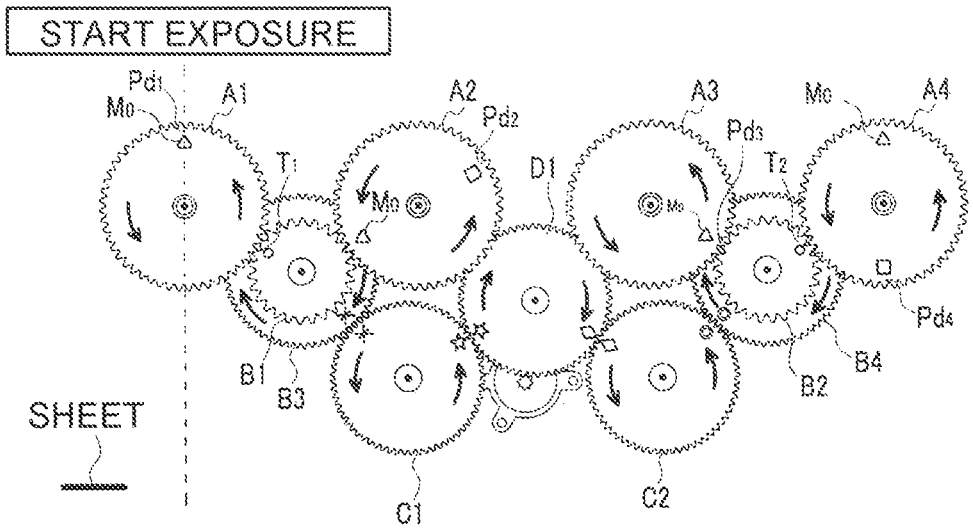
FIGS. 14A to 14C are drawings showing an action of the gear transmission mechanism.
Figure 14B:
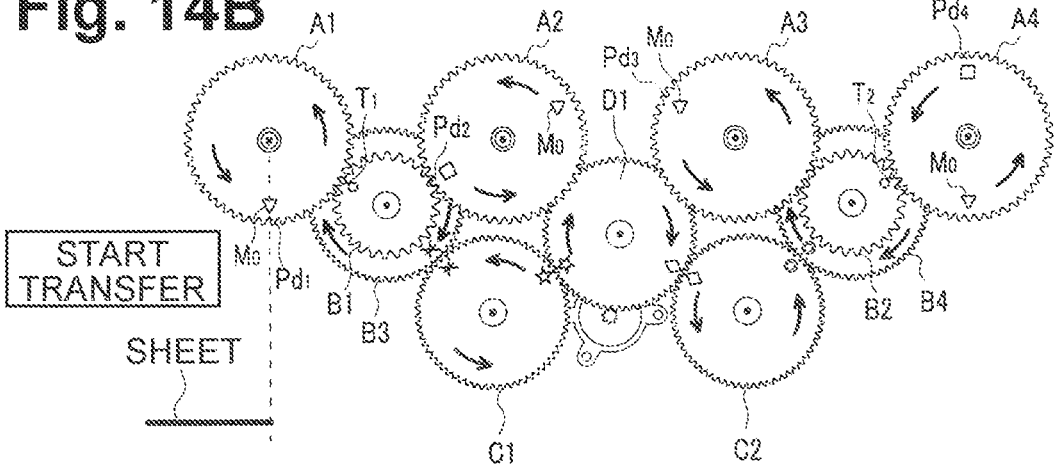
Figure 14C:
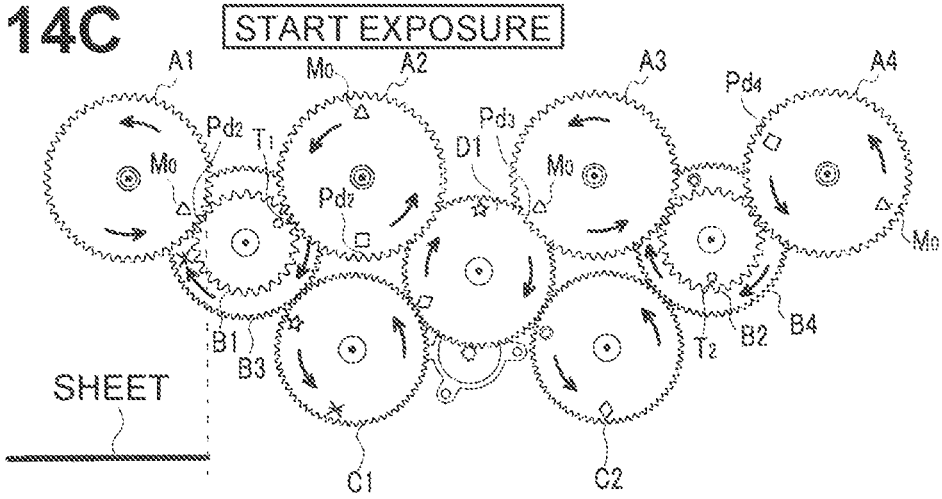

More specifically, when a leading end of the paper in the direction of movement reaches a predetermined position with respect to the transfer position of the first photosensitive drum 31, the exposure of the first photosensitive drum 31 is started (see FIG. 14A). Then, when the paper reaches a predetermined position with respect to the transfer position of the second photosensitive drum 32 after the start of the transfer from the first photosensitive drum 31 from a moment when the paper reaches the transfer position of the first photosensitive drum 31 (see FIG. 14B), the exposure of the second photosensitive drum 32 is started (see FIG. 14C).

Figure 15A:
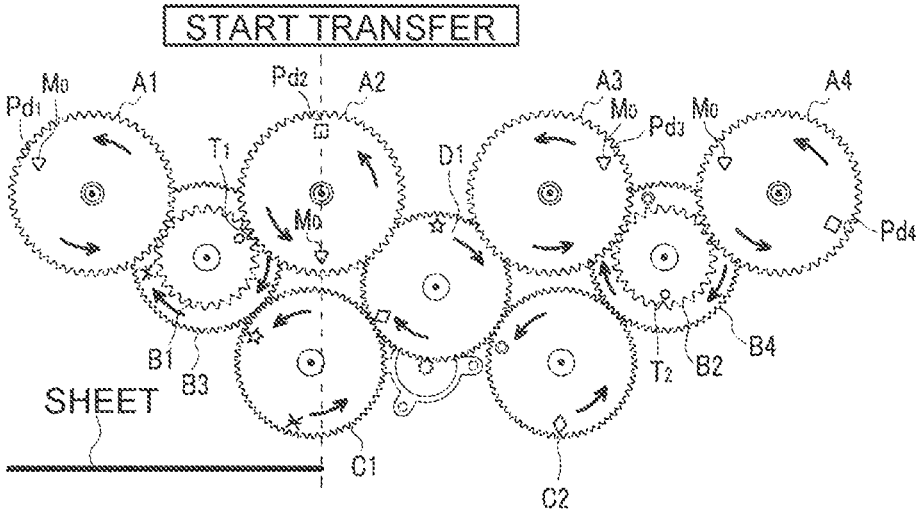
FIGS. 15A to 15C are drawings showing the action of the gear transmission mechanism.
Figure 15B:
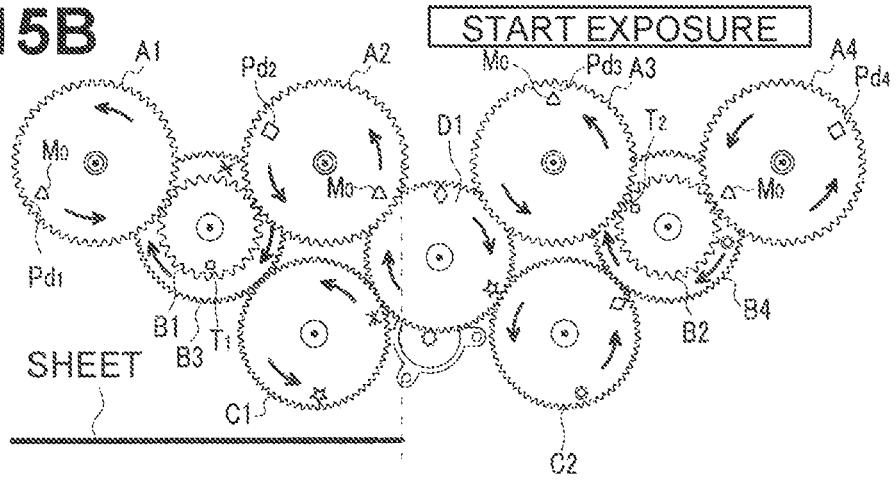
Figure 15C:
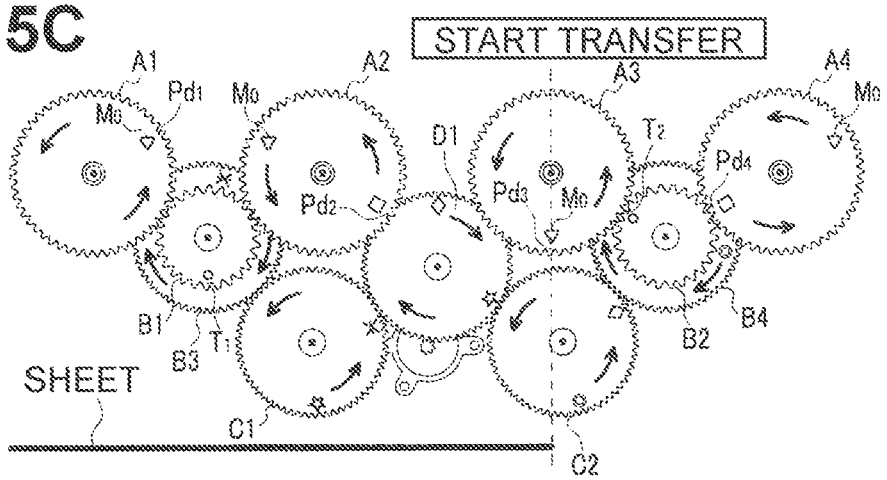

Subsequently, when the paper reaches a predetermined position with respect to the transfer position of the third photosensitive drum 33 after the start of the transfer from the second photosensitive drum 32 from a moment when the paper reaches the transfer position of the second photosensitive drum 32 (see FIG. 15A), the exposure of the third photosensitive drum 33 is started (see FIG. 15B), and the transfer from the third photosensitive drum 33 is started from a moment when the paper reaches the transfer position of the third photosensitive drum 33 (see FIG. 15C).

Figure 16A:
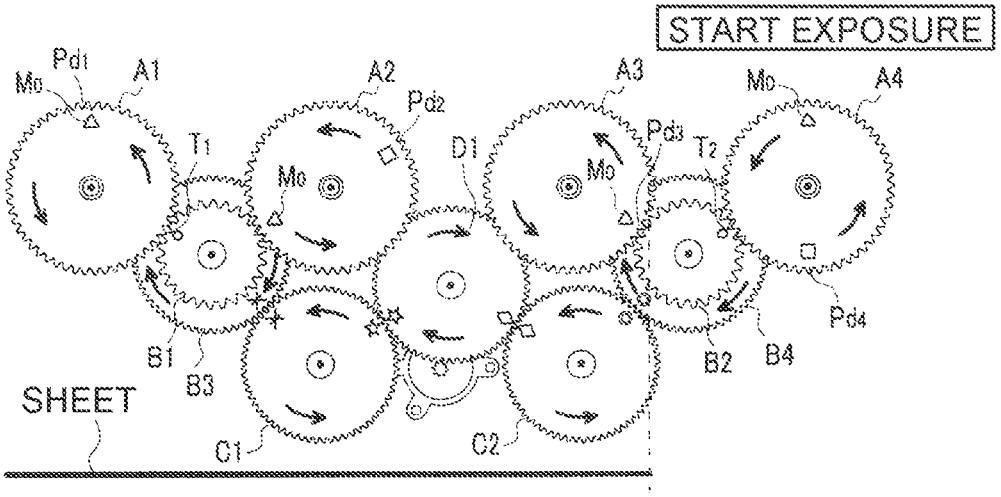
FIGS. 16A and 16B are drawings showing the action of the gear transmission mechanism.
Figure 16B:
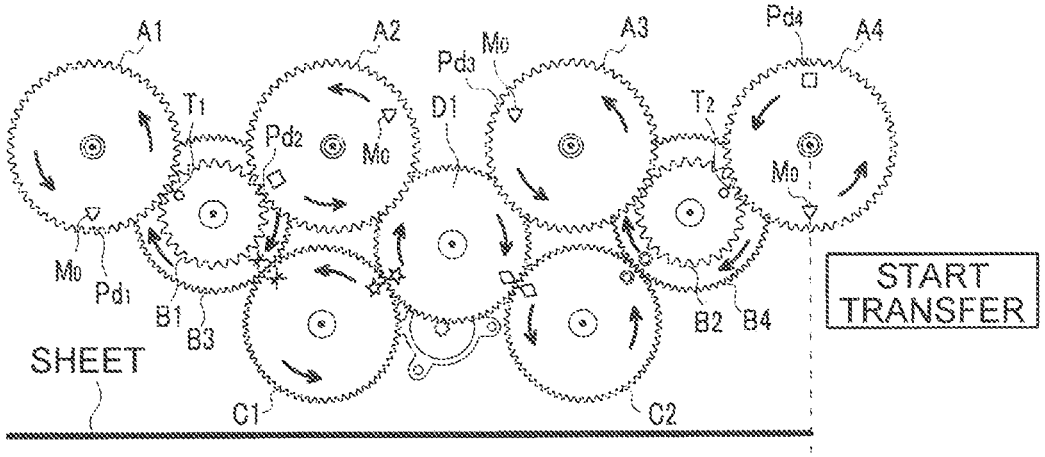

Then, when the paper reaches a predetermined position with respect to the transfer position of the fourth photosensitive drum 34, exposure of the fourth photosensitive drum 34 is started (see FIG. 16A), and when the paper reaches the transfer position of the fourth photosensitive drum 34, the transfer from the fourth photosensitive drum 34 is started (see FIG. 16B).

3. Characteristics of Image Forming Apparatus (Specifically, Drive System of Photosensitive Drum) According to the Embodiment As described above as "subject to be solved by the invention", (a) when a reference pitch circle of the gear is not a complete round and the radius of a reference pitch circle varies from portion to portion of the gear, the circumferential speeds of the respective teeth formed on the outer periphery of the gear vary even when the angular speeds are the same. (b) When the reference pitches (dimensions between adjacent teeth) are different from portion to portion of the gear, the circumferential speeds of the respective teeth formed on the outer periphery of the gear vary even when the angular speed and the radius of the reference pitch circle are the same.

Figure 17A:
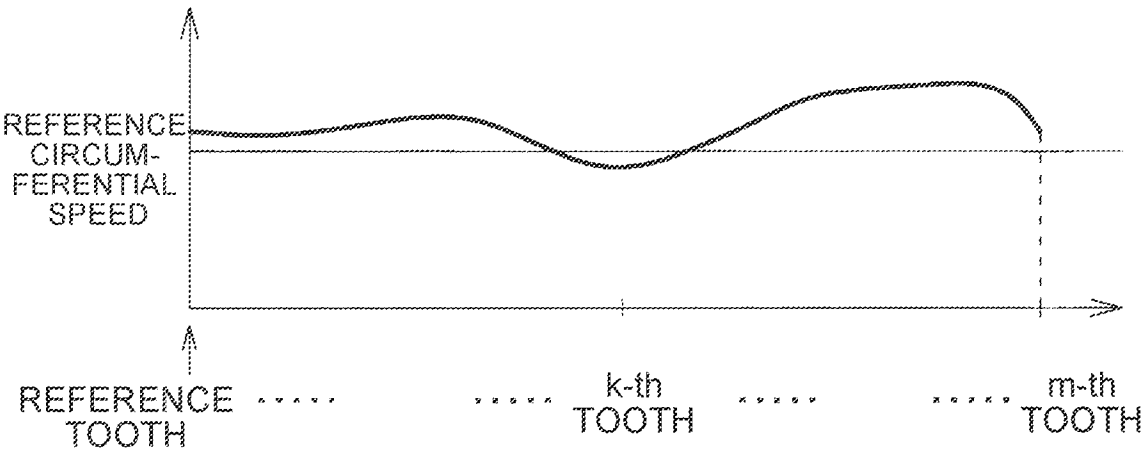
FIG. 17A is a graph showing circumferential speed variability characteristics of the gear.
Figure 17B:
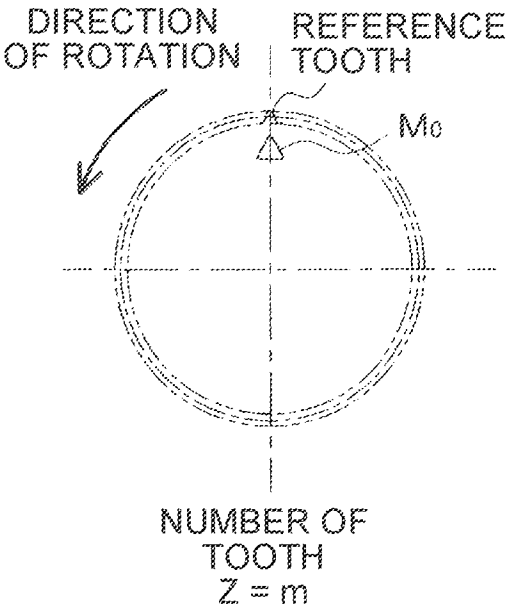
FIG. 17B is a front view of the gear.

In other words, the circumferential speeds of the respective teeth vary with respect to the circumferential speed in design (hereinafter, referred to as the reference circumferential speed) as shown in FIG. 17A, for example. Hereinafter, the variations in circumferential speed are referred to as "circumferential speed variation characteristics".

Then, in the embodiment, since the first to fourth drum gears A1 to A4 are molded using the same die, all of the first to fourth drum gears A1 to A4 may be considered to be congruent including the position of the identification mark Mo (reference tooth), the circumferential speed variation characteristics of the respective first to fourth drum gears A1 to A4 are all the same.

In the same manner, the circumferential speed variation characteristics of the first drive gear B1 (including the first transmission gear B3) and the circumferential speed variation characteristics of the second drive gear B2 (including the second transmission gear B4) may be considered to be the same, and the circumferential speed variation characteristics of the first intermediate gear C1 and the circumferential speed variation characteristics of the second intermediate gear C2 may be considered to be the same.

Incidentally, when the circumferential speed of the photosensitive drum 3A at the time of exposure and the circumferential speed of the photosensitive drum 3A at the time of transfer are significantly different, the image formed on the paper is expanded or contracted in the direction of movement of the paper with respect to the original image. Then, examples of main causes of the circumferential speed variation of the photosensitive drum 3A includes dimensional unevenness of the drive gear B (circumferential speed characteristics).

In contrast, as is clear from FIG. 14 to FIG. 16, the embodiment is characterized by a configuration in which the first drive specific tooth T1 meshes with the first drum gear A1 when the first drum specific position Pd1 is located at the transfer position, and the first drive specific tooth T1 meshes with the second drum gear A2 when the second drum specific position Pd2 is located at the transfer position, and, in addition, the second drive specific tooth T2 meshes the third drum gear A3 when the third drum specific position Pd3 is located at the transfer position, and the second drive specific tooth T2 meshes with the fourth drum gear A4 when the fourth drum specific position Pd4 is located at the transfer position.

I addition, the embodiment is characterized by a configuration in which the first drive specific tooth T1 meshes with the first drum gear A1 when the first drum specific position Pd1 is located at the exposure position, and the first drive specific tooth T1 meshes with the second drum gear A2 when the second drum specific position Pd2 is located at the exposure position, and, in addition, the second drive specific tooth T2 meshes the third drum gear A3 when the third drum specific position Pd3 is located at the exposure position, and the second drive specific tooth T2 meshes with the fourth drum gear A4 when the fourth drum specific position Pd4 is located at the exposure position.

In other words, the embodiment is characterized by a configuration in which the first drive specific tooth T1 and the second drive specific tooth T2 mesh with corresponding ones of the first to fourth drum gears A1 to A4 when the respective photosensitive drums 31 to 34 are located on the exposure positions and the transfer positions.

Therefore, since the first drive gear B1 and the second drive gear B2 have the same circumferential speed variation characteristics, the photosensitive drum 3A (drum gear A) is applied with a rotational force having the same circumferential speed from the drive gear B at the time of exposure and at the time of transfer.

In other words, the circumferential speed of the first drum specific position Pd1 at the exposure position and the transfer position and the circumferential speed of the second drum specific position Pd2 at the exposure position and the transfer position are the same circumferential speed. In the same manner, the circumferential speed of the third drum specific position Pd3 at the exposure position and the transfer position and the circumferential speed of the fourth drum specific position Pd4 at the exposure position and the transfer position are the same circumferential speed.

Therefore, in the embodiment, since the influence of the dimensional unevenness of the drive gear B may be eliminated, even when the dimensional unevenness of the drive gear B occurs, the difference between the circumferential speed of the photosensitive drum 3A at the exposure position and the circumferential speed of the photosensitive drum 3A at the transfer position may be reduced. Therefore, occurrence of the image formation failure caused by the difference between the circumferential speed at the time of exposure and the circumferential speed at the time of transfer may be inhibited.

Incidentally, if there is dimensional unevenness in the gear, the circumferential speeds vary from portion to portion of the gear even when the gear is rotated at a constant angular speed as described above. Therefore, when the circumferential speed of the gear is measured at a specific standstill position with respect to the rotating gear, the circumferential speed varies cyclically with a period of one turn (see FIG. 17A).

In contrast, the embodiment is characterized by a configuration in which the reference tooth of the second drum gear A2 is shifted from the transfer position by the first shift angle, the reference tooth of the third drum gear A3 is shifted from the transfer position by the second shift angle, and the reference tooth of the fourth drum gear A4 is shifted from the transfer position by the third shift angle when the reference tooth of the first drum gear A1 is located at the transfer position as shown in FIG. 9.

Figure 18:
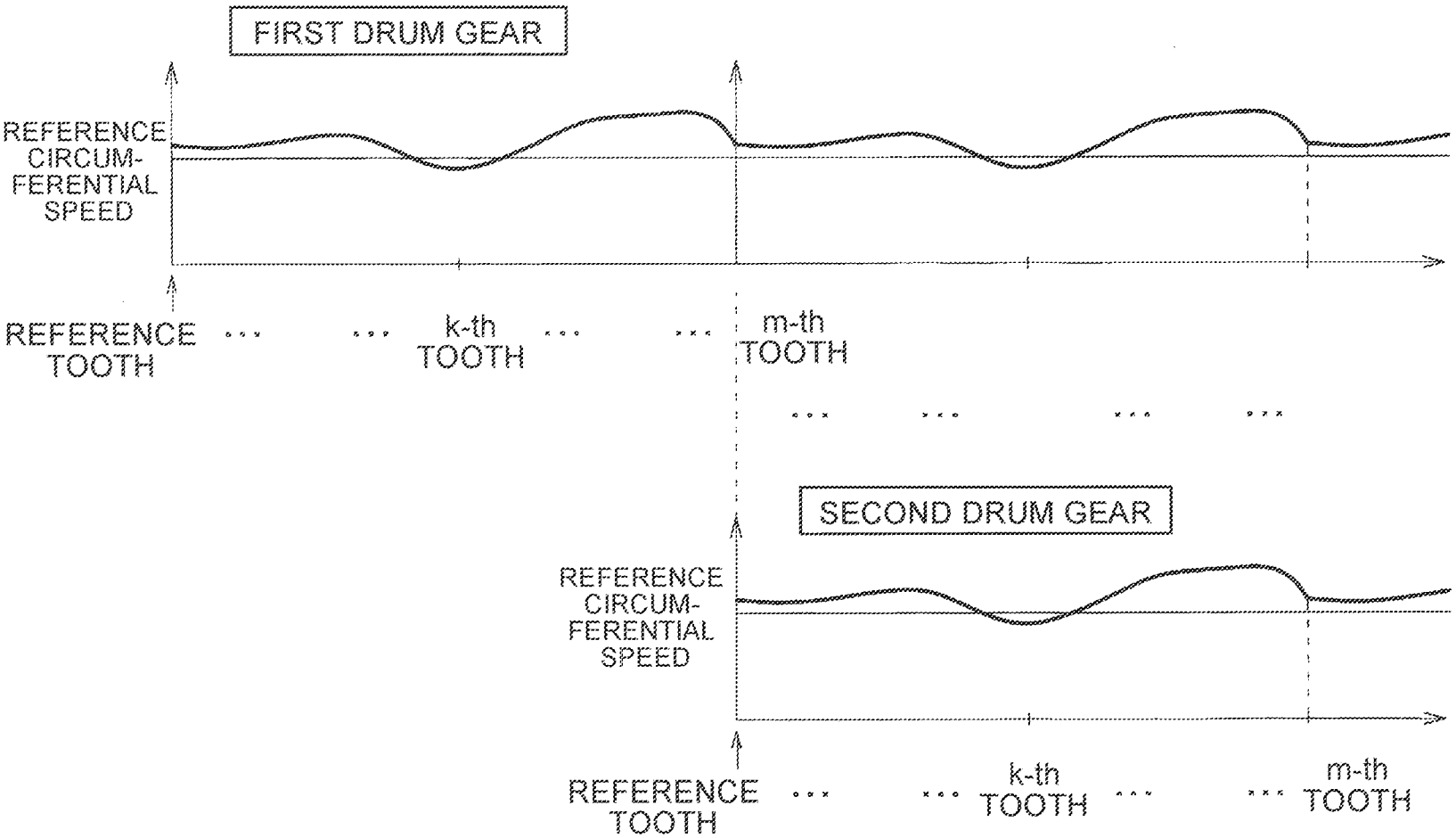
FIG. 18 is a drawing for explaining characteristics of the image forming apparatus according to the embodiment of the invention.

Accordingly, according to the embodiment, when focusing on the first drum gear A1 and the second drum gear A2, since the cycle of the circumferential speed variation characteristics of the first drum gear A1 and the cycle of the circumferential speed variation characteristics of the second drum gear A2 are synchronized (matched) as shown in FIG. 18, the relative amount of difference of the circumferential speed of the second drum gear A2 with respect to the circumferential speed of the first drum gear A1 can be reduced.

In the same manner, since the cycle of the circumferential speed variation characteristics of the first drum gear A1, the cycle of the circumferential speed variation characteristics of the third drum gear A3, and the cycle of the circumferential speed variation characteristics of the fourth drum gear A4 are synchronized (matched), the relative amount of difference of the circumferential speeds of the third drum gear A3 and the fourth drum gear A4 with respect to the circumferential speed of the first drum gear A1 can be reduced.

Accordingly, in the embodiment, since the cycles of the circumferential speed variation characteristics of the drum gears A1 to A4 can be synchronized even when there are dimensional unevenness in the drum gear A, the difference in circumferential speed between the first photosensitive drum 31 and the second photosensitive drum 32 to the fourth photosensitive drum 34 at the time of exposure and at the time of transfer can be reduced. Consequently, occurrence of the image formation failure can be inhibited.

As described thus far, in the embodiment, the circumferential speed variations at the time of exposure and at the time of transfer are matched, and the circumferential speed variations of the first drum gear A1 and the circumferential speed variations of the second drum gear A2 to the fourth drum gear A4 are matched. Therefore, even when there are dimensional unevenness in the drum gear A and the drive gears B, occurrence of the image formation failure can be inhibited.

Incidentally, as specific means for "making the circumferential speed variations at the time of exposure and at the time of transfer matched", in the embodiment, the numbers of teeth of the drum gear A and the drive gear B or the like are set so that while the drum specific positions Pd1 to Pd4 set on the photosensitive drum 3A rotate from the exposure positions to the transfer positions, the corresponding drive gear B is rotated by an integer number of times (one turn in the embodiment). Hereinafter, this set condition is referred to as a first set condition.

As specific means for "making the circumferential speed variations of the first drum gear A1 and the circumferential speed variations of the second drum gear A2 to the fourth drum gear A4 matched", in the embodiment, the number of teeth or the like is set so that the drive gear B rotates by an integer number of times (two turns in the embodiment) while the drum gear A makes a 360° turn. Hereinafter, this set condition is referred to as a second set condition.

In the above-described first and second set conditions, there is a case where the number of times of rotation of the drive gear B cannot be set to a strict integer number of times depending on the number of tooth Z, a module m, and the radius of the reference pitch circle. However, if at least as long as the number of teeth Z1 of the drum gear A is an integral multiple of the number of teeth Z2 of the drive gears B, it is considered to have a configuration which satisfies the first and second set conditions described above.

In the embodiment, since the transmission angle θ2 is twice the drive angle θ1 and the drive angle θ1 is set to be π/2 radian or larger, lines connecting the centers of the drive gears B the intermediate gear C and the distribution gear D1 form a W shape as shown in FIG. 2.

Incidentally, when the drive angle θ1 is set to be smaller than π/2 radian, the lines connecting the centers of the drive gear B, the intermediate gear C, and the distribution gear D1 form a V shape. Therefore, in comparison with a configuration in which the lines connecting the centers of the drive gear B, the intermediate gear C, and the distribution gear D1 form a W shape, upsizing of the dimension in the direction orthogonal to the axial direction (the vertical direction in the embodiment) from the outside dimension of the gear transmission mechanism including the gears A1 to A4, B1 and B2, C1 and C2, and D1 may be resulted.

In other words, in the embodiment, since the lines connecting the centers of the drive gear B, the intermediate gear C, and the distribution gear D1 form a W shape, the center of rotation of the distribution gear D1 is shifted toward the drum gear A with respect to the center of rotation of the intermediate gear C. Therefore, upsizing of the dimensions in the direction orthogonal to the axial direction (the vertical direction in the embodiment) from among the outside dimensions of the gear transmission mechanism can be inhibited.

For the sake of reference, the drive angle A1 is generally determined by an expression 1 shown below, and is Z1>Z2 and P1>D (=L1/π) as described above, the drive angle θ1 generally becomes π/2 radian or larger.

$$\theta 1=2\cdot[P1-n\cdot L1(Z2/Z1)] \qquad \text{Expression 1}$$

where P1 is an axis-to-axis distance of the photosensitive drums, n is a natural number, L1 is a peripheral length of the photosensitive drum, Z1 is the number of teeth of the drum gear, and Z2 is the number of teeth of the drive gear.

In the embodiment, when demounting the process cartridge 3 from the apparatus body, the photosensitive drum 3A and the drum gear A are separated. Therefore, the phase of the drum gear A is prevented from being shifted from the above-described phase (from the state shown in FIG. 2 and FIG. 9) when the process cartridge 3 is replaced. Therefore, even when the process cartridge 3 is replaced, occurrence of problem such that the image formation failure results due to the displacement of the phase of the drum gear A or the like is prevented.

In the embodiment, since the drive gears B, the intermediate gears C, and the distribution gear D1 are configured with the helical gears, a plurality of teeth mesh with each other simultaneously. Therefore, even when there are dimensional unevenness of the gears, plays among the gears are averaged, and hence the occurrence of the image formation failure can be inhibited.

In FIG. 15 to FIGS. 17A and 17B, as is clear from the asterisks, the stars, the rhomboids, and the double circles marked on the respective gears, the transmission gear B3 and the intermediate gear C1 mesh with each other always in combinations of the same teeth, and the intermediate gear C and the distribution gear D1 mesh with each other always in combinations of the same teeth and, in addition, the combinations of the meshed teeth at the time of exposure and the combinations of the meshed teeth at the time of transfer are the same. Therefore, the circumferential speed variations at the time of exposure and at the time of transfer can be matched, so that the occurrence of the image formation failure can be inhibited even when the dimensional unevenness occurs in the drive gear B and the intermediate gear C.

OTHER EMBODIMENTS

In the embodiment described above, the characteristics of the invention of the present application has been described by focusing mainly on the relationship between the drum gear A and the drive gear B of the gear transmission mechanism. However, the invention may be applied also to the other gears (for example, the relationship between the first transmission gear B3 and the first intermediate gear C1 and the relationship between the intermediate gear C and the distribution gear D1).

In the embodiment described above, the invention is applied to a direct system in which a plurality of developer images are superimposed on paper. However, the invention is not limited thereto, and may be applied to an image forming apparatus of an intermediate transfer system in which developer images carried on the photosensitive drum 3A are transferred to an intermediate transfer belt so as to be superimposed thereon and the developer image formed on the intermediate transfer belt is transferred to the paper.

In the embodiment describe above, the invention is applied to the image forming apparatus having four the photosensitive drums 3A, the application of the invention is not limited thereto, and the invention of the present application is applicable to an image forming apparatus as long as two or more photosensitive drum 3A are provided.

In the embodiment described above, the exposure unit 4 is of an LED system. However, the invention is not limited thereto, and an exposure unit of so-called a scanner system having a configuration in which the photosensitive drum 3A is scanned with a laser beam in the axial direction is also applicable.

A coupling mechanism that couples the photosensitive drum 3A and the drum gear A is not limited to those having a configuration shown in the embodiment described above.

In the embodiment described above, the gear transmission mechanism is configured with the helical gears. However, the invention is not limited thereto, and the gear transmission mechanism may be configured with spur gears, for example.

In the embodiment described above, the respective drum gear A are coupled to the rotating shafts of the photosensitive drum 3A and are rotated integrally with the photosensitive drums 3A. However, the invention is not limited thereto.

In the embodiment described above, the identification mark Mo is formed using the gear molding die simultaneously with the molding of the first to fourth drum gears A1 to A4. However, the invention is not limited thereto and, for example, the identification mark Mo may be formed by painting or the like.

The invention may only conform the scope of the invention described in Claims, and is not limited to the above-described embodiment.

What is claimed is:

1. An image forming apparatus configured to form an image on a transfer member by transferring a developer image onto the transfer member, comprising:

a first photosensitive drum configured to carry a developer image to be transferred to the transfer member;

a second photosensitive drum configured to carry a developer image to be transferred to the transfer member and disposed at a position downstream in a direction of movement of the transfer member with respect to the first photosensitive drum, and the second photosensitive drum having the same diameter as the first photosensitive drum;

a first exposing unit configured to form an electrostatic latent image by exposing an outer peripheral surface of the first photosensitive drum by irradiating an exposure position with respect to the first photosensitive drum with a light beam;

a second exposing unit configured to form an electrostatic latent image by exposing an outer peripheral surface of the second photosensitive drum by irradiating an exposure position with respect to the second photosensitive drum with a light beam;

a first developing unit configured to supply a developer to the first photosensitive drum to develop the electrostatic latent image formed on the first photosensitive drum;

a second developing unit configured to supply a developer to the second photosensitive drum to develop the electrostatic latent image formed on the second photosensitive drum;

a first transfer unit configured to cause the developer image formed on the first photosensitive drum to be transferred to the transfer member at a transfer position;

a second transfer unit configured to cause the developer image formed on the second photosensitive drum to be transferred to the transfer member at a transfer position;

a first drum gear configured to apply a rotational force to the first photosensitive drum;

a second drum gear configured to apply a rotational force to the second photosensitive drum; and a first drive gear configured to apply a rotational force to the first drum gear and the second drum gear by meshing with the first drum gear and the second drum gear, wherein when a specific position on the outer peripheral surface of the first photosensitive drum selected arbitrarily is referred to as a first drum specific position, a tooth of the first drive gear meshed with the first drum gear when the first drum specific position is located at the exposure position is referred to as a first drive specific tooth, and when a portion of the outer peripheral surface of the second photosensitive drum located at the exposure position when the first drive specific tooth is meshed with the second drum gear is referred to as a second drum specific position, the first drive specific tooth meshes with the first drum gear when the first drum specific position is located at the transfer position, and the first drive specific tooth meshes with the second drum gear when the second drum specific position is located at the transfer position, the first drive specific tooth meshes with the first drum gear both when the first exposing unit starts exposing the first photosensitive drum with a first image to be transferred to a transfer member and when the first transfer unit starts transferring the first image to the same transfer member, and the same first drive specific tooth further meshes with the second drum gear both when the second exposing unit starts exposing the second photosensitive drum with a second image to be transferred to the same transfer member and when the second transfer unit starts transferring the second image to the same transfer member, when an arbitrarily selected tooth which serves as a reference is referred to as a reference tooth from among a plurality of teeth formed on the first drum gear, a tooth from among a plurality of teeth formed on the second drum gear is referred to as a reference tooth of the second drum gear, and when a plane angle obtained by dividing a value obtained by subtracting an axis-to-axis dimension of the first and second photosensitive drums from a peripheral length of the first photosensitive drum by the peripheral length of the first photosensitive drum is referred to as a first shift angle, the reference tooth of the second drum gear is shifted by the first shift angle from the transfer position assuming that a forward direction in a direction of rotation is a normal direction when the reference tooth of the first drum gear is located at the transfer position.

2. The image forming apparatus according to claim 1, wherein the first drum gear, the second drum gear, and the first drive gear are configured in such a manner that the first drive gear rotates by an integer number of times while the first drum specific position and the second drum specific position rotate from the exposure position to the transfer position.

3. The image forming apparatus according to claim 1, wherein the first drive gear rotates by an integer number of times while the first drum gear and the second drum gear rotate by a 360° turn.

4. The image forming apparatus according to claim 1, further comprising:

a third photosensitive drum configured to carry the developer image to be transferred to the transfer member and disposed at a position downstream in the direction of movement of the transfer member with respect to the second photosensitive drum, and having the same diameter as the first photosensitive drum;

a fourth photosensitive drum configured to carry the developer image to be transferred to the transfer member and disposed at a position downstream in the direction of movement of the transfer member with respect to the third photosensitive drum, and having the same diameter as the first photosensitive drum;

a third exposing unit configured to form an electrostatic latent image by exposing an outer peripheral surface of the third photosensitive drum by irradiating an exposure position with respect to the third photosensitive drum with a light beam;

a fourth exposing unit configured to form an electrostatic latent image by exposing an outer peripheral surface of the fourth photosensitive drum by irradiating an exposure position with respect to the fourth photosensitive drum with a light beam;

a third developing unit configured to supply a developer to the third photosensitive drum to develop the electrostatic latent image formed on the third photosensitive drum;

a fourth developing unit configured to supply a developer to the fourth photosensitive drum to develop the electrostatic latent image formed on the fourth photosensitive drum;

a third transfer unit configured to cause the developer image formed on the third photosensitive drum to be transferred to the transfer member at a transfer position;

a fourth transfer unit configured to cause the developer image formed on the fourth photosensitive drum to be transferred to the transfer member at a transfer position;

a third drum gear configured to apply a rotational force to the third photosensitive drum;

a fourth drum gear configured to apply a rotational force to the fourth photosensitive drum;

a second drive gear configured to apply a rotational force to the third drum gear and the fourth drum gear by meshing with the third drum gear and the fourth drum gear, and intermediate gears configured to apply a rotational force to the first drive gear and the second drive gear, wherein when a specific position on the outer peripheral surface of the third photosensitive drum selected arbitrarily is referred to as a third drum specific position, a tooth of the second drive gear meshed with the third drum gear when the third drum specific position is located at the exposure position is referred to as a second drive specific tooth, and a portion of the outer peripheral surface of the fourth photosensitive drum located at the exposure position when the second drive specific tooth is meshed with the fourth drum gear is referred to as a fourth drum specific position, the second drive specific tooth meshes with the third drum gear when the third drum specific position is located at the transfer position, and the second drive specific tooth meshes with the fourth drum gear when the fourth drum specific position is located at the transfer position, and when a tooth from among a plurality of teeth formed on the third drum gear is referred to as a reference tooth of the third drum gear, a tooth from among a plurality of teeth formed on the fourth drum gear is referred to as a reference tooth of the fourth drum gear, a plane angle obtained by dividing a value obtained by subtracting an axis-to-axis dimension of the first and third photosensitive drums from the peripheral length of the first photosensitive drum by the peripheral length of the first photosensitive drum is referred to as a second shift angle, and a plane angle obtained by dividing a value obtained by subtracting an axis-to-axis dimension of the first and fourth photosensitive drums from the peripheral length of the first photosensitive drum by the peripheral length of the first photosensitive drum is referred to as a third shift angle, the reference tooth of the third drum gear is shifted by the second shift angle from the transfer position assuming that the forward direction in the direction of rotation is a normal direction when the reference tooth of the first drum gear is located at the transfer position, and the reference tooth of the fourth drum gear is shifted by the third shift angle from the transfer position, and the first drive gear, the second drive gear, and the intermediate gears rotate by an integer number of times while the first to the fourth drum gears rotate by a 360° turn.

5. The image forming apparatus according to claim 4, wherein the third drum gear, the fourth drum gear, and the second drive gear are configured in such a manner that the second drive gear rotates by an integer number of times while the third drum specific position and the fourth drum specific position rotate from the exposure position to the transfer position.

6. The image forming apparatus according to claim 4, further comprising:

a distribution gear configured to distribute a rotational force transmitted from a drive source to the first drive gear and the second drive gear, wherein the intermediate gears include a first intermediate gear configured to mesh with the distributing gear to apply a rotational force to the first drive gear and a second intermediate gear configured to mesh with the distribution gear to apply a rotational force to the second drive gear, an angle formed between an imaginary line passing through a center of rotation of the first drum gear and a center of rotation of the first drive gear and an imaginary line passing through a center of rotation of the second drum gear and the center of rotation of the first drive gear is set to be equal to an angle formed between an imaginary line passing through a center of rotation of the third drum gear and a center of rotation of the second drive gear and an imaginary line passing through a center of rotation of the fourth drum gear and the center of rotation of the second drive gear, and an angle formed between an imaginary line passing through a center of rotation of the distribution gear and a center of rotation of the first intermediate gear and an imaginary line passing through the center of rotation of the distribution gear and a center of rotation of the second intermediate gear is set to be double the angle formed between the imaginary line passing through the center of rotation of the first drum gear and the center of rotation of the first drive gear and the imaginary line passing through the center of rotation of the second drum gear and the center of rotation of the first drive gear.

7. The image forming apparatus according to claim 6, wherein the angle formed between the imaginary line passing through the center of rotation of the first drum gear and the center of rotation of the first drive gear and the imaginary line passing through the center of rotation of the second drum gear and the center of rotation of the first drive gear is $\pi/2$ radian or larger.

8. The image forming apparatus according to claim 6, further comprising:

a first transmission gear arranged coaxially with the first drive gear and configured to mesh the first intermediate gear; and a second transmission gear arranged coaxially with the second drive gear and configured to mesh the second intermediate gear, wherein the first drive gear and the first transmission gear are integrally formed and the second drive gear and the second transmission gear are integrally formed.

9. The image forming apparatus according to claim 1, wherein the first drum gear and the second drum gear are helical gears whose direction of lead is inclined with respect to the direction of an axis of rotation.

10. The image forming apparatus according to claim 1, wherein the first drum gear and the second drum gear are molded using the same die, and an identification mark indicating the reference tooth is formed using the die simultaneously with the molding of the drum gears.

* * * * *